US010667071B2

(12) United States Patent
Horbach et al.

(10) Patent No.: US 10,667,071 B2
(45) Date of Patent: May 26, 2020

(54) LOW COMPLEXITY MULTI-CHANNEL SMART LOUDSPEAKER WITH VOICE CONTROL

(71) Applicant: HARMAN INTERNATIONAL INDUSTRIES, INCORPORATED, Stamford, CT (US)

(72) Inventors: Ulrich Horbach, Canyon Country, CA (US); Matthias Kronlachner, Regensburg (DE)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/994,389

(22) Filed: May 31, 2018

(65) Prior Publication Data

US 2019/0373390 A1 Dec. 5, 2019

(51) Int. Cl.

| | |
|---|---|
| ***H04R 5/027*** | (2006.01) |
| ***H04S 3/00*** | (2006.01) |
| ***H04S 7/00*** | (2006.01) |

(52) U.S. Cl.

CPC ..... *H04S 7/301* (2013.01); *H04R 5/027* (2013.01); *H04S 3/002* (2013.01); *H04S 7/305* (2013.01); *H04S 2400/01* (2013.01)

(58) Field of Classification Search

CPC ..... H04S 7/301; H04S 3/002; H04S 7/305; H04S 2400/01; H04R 5/027

See application file for complete search history.

(56) References Cited

U.S. PATENT DOCUMENTS

| | | | | |
|---|---|---|---|---|
| 7,991,170 | B2 | 8/2011 | Horbach | |
| 9,294,860 | B1 | 3/2016 | Carlson | |
| 9,749,747 | B1 * | 8/2017 | Kriegel | H04R 5/02 |
| 10,109,292 | B1 * | 10/2018 | Choisel | G10L 21/0232 |
| 2006/0233389 | A1 | 10/2006 | Mao et al. | |
| 2011/0051950 | A1 * | 3/2011 | Burnett | G10L 21/0208 381/92 |
| 2013/0208895 | A1 | 8/2013 | Horbach et al. | |
| 2015/0030164 | A1 | 1/2015 | Ranieri et al. | |
| 2017/0006399 | A1 * | 1/2017 | Maziewski | H04R 3/04 |
| 2017/0236547 | A1 * | 8/2017 | Baggio | G11B 20/10527 381/26 |
| 2017/0366897 | A1 | 12/2017 | Azarewicz et al. | |
| 2018/0098172 | A1 * | 4/2018 | Family | H04R 1/403 |
| 2018/0226065 | A1 * | 8/2018 | Marquez | G10K 11/346 |

FOREIGN PATENT DOCUMENTS

| | | | |
|---|---|---|---|
| GB | 2545359 | A | 6/2017 |
| WO | 2018045133 | A1 | 3/2018 |

* cited by examiner

*Primary Examiner* — Sonia L Gay
(74) *Attorney, Agent, or Firm* — Brooks Kushman P.C.

(57) ABSTRACT

A digital signal processor is programmed to extract a center channel from a stereo input, apply the center channel to an array of speaker elements using a first set of finite impulse response filters and a first rotation matrix to generate a first beam of audio content at a target angle about the axis, apply a left channel of the stereo input to the array of speaker elements using a second set of finite impulse response filters and a second rotation matrix to generate a second beam of audio content at a first offset angle from the target angle about the axis, and apply a right channel of the stereo input to the array of speaker elements using a third set of finite impulse response filters and third rotation matrix to generate a third beam of audio content at a second offset angle from the target angle about the axis.

19 Claims, 33 Drawing Sheets

1800

LOW COMPLEXITY MULTI-CHANNEL SMART LOUDSPEAKER WITH VOICE CONTROL

TECHNICAL FIELD

Aspects of the disclosure generally relate to a low complexity multi-channel smart loudspeaker with voice control.

BACKGROUND

Smart loudspeakers with voice control and Internet connectivity are becoming increasingly popular. End users expect the product to perform various functions, including understanding a user's voice from any distant point in a room even while music is playing, responding and interacting quickly to user requests, focusing on one voice command and suppressing others, playing back stereo music with high quality, filling the room with music like a small home theater system, and automatically steering to the position of user listening in the room.

SUMMARY

In one or more illustrative examples, a smart loudspeaker includes an array of N speaker elements disposed in a circular configuration about an axis and configured for multi-channel audio playback and a digital signal processor. The digital signal processor is configured to extract a center channel from a stereo input, apply the center channel to the array of speaker elements using a first set of finite input response filters and a first rotation matrix to generate a first beam of audio content at a target angle about the axis, apply a left channel of the stereo input to the array of speaker elements using a second set of finite input response filters and a second rotation matrix to generate a second beam of audio content at a first offset angle from the target angle about the axis, and apply a right channel of the stereo input to the array of speaker elements using a third set of finite input response filters and a third rotation matrix to generate a third beam of audio content at a second offset angle from the target angle about the axis.

In one or more illustrative examples, a method for a smart loudspeaker includes extracting a center channel from a stereo input; applying the center channel to an array of speaker elements disposed in a circular configuration about an axis and configured for multi-channel audio playback, using a first set of finite input response filters and a first rotation matrix to generate a first beam of audio content at a target angle about the axis; applying a left channel of the stereo input to the array of speaker elements using a second set of finite input response filters and a second rotation matrix to generate a second beam of audio content at a first offset angle from the target angle about the axis; and applying a right channel of the stereo input to the array of speaker elements using a third set of finite input response filters and a third rotation matrix to generate a third beam of audio content at a second offset angle from the target angle about the axis.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In order to realize smart loudspeaker features, a combination of a powerful host processor with WIFI connectivity, a real-time signal processor comprising steerable beam forming for both received and sent sound, and multichannel echo cancelling filter banks are required. These components require a massive demand for processing power. On the other hand, wireless portability with battery power options is often desirable. This disclosure presents a solution that fulfills the demand for audio quality and smart loudspeaker features, while minimizing processing cost.

Figure 1:
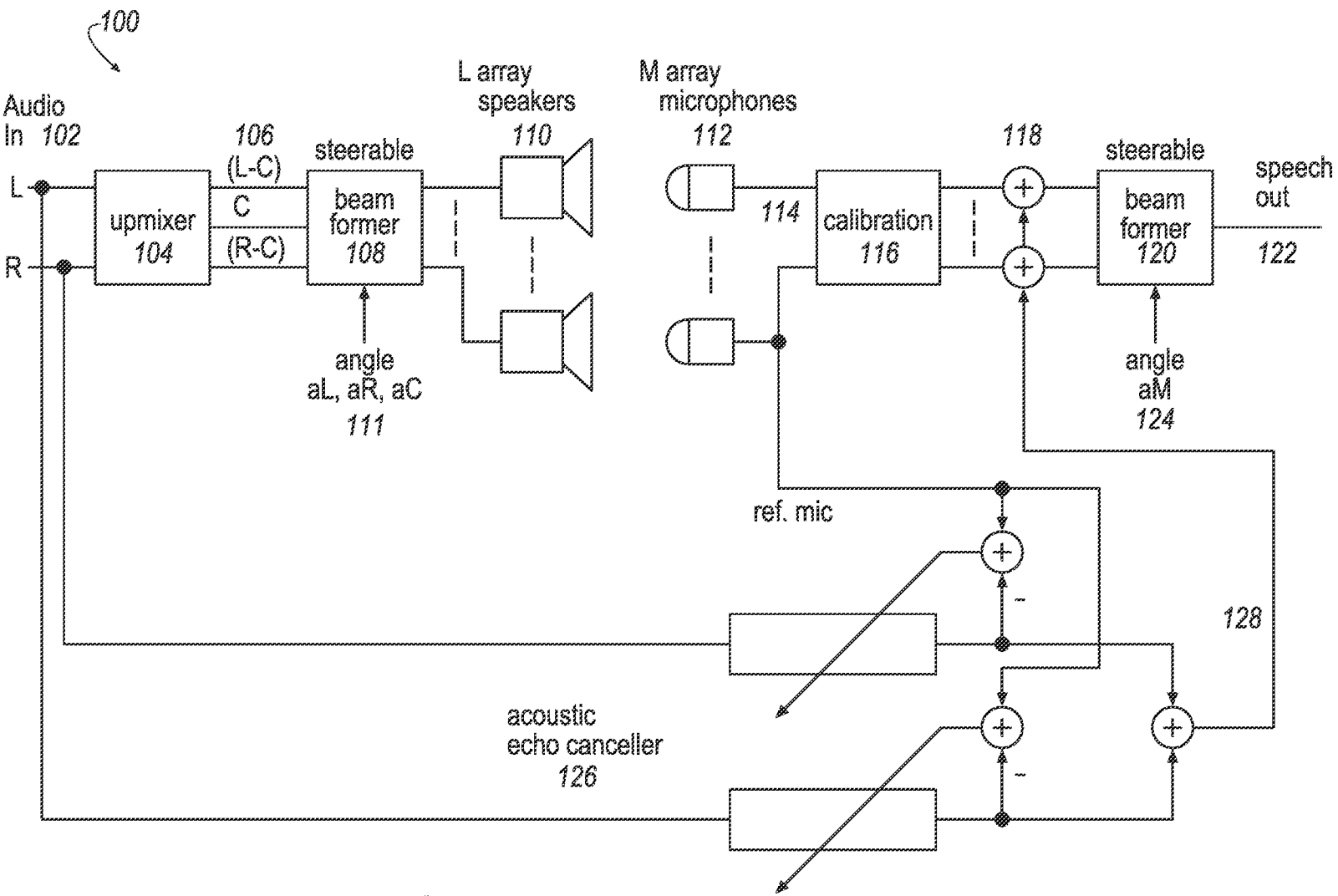
FIG. 1 illustrates a simplified block diagram of a smart loudspeaker.

FIG. 1 illustrates a simplified block diagram of a smart loudspeaker 100. As shown, the circuit in the diagram receives an audio input 102 having left (L) and right (R) channels. This audio input 102 is provided to an upmixer 104. The upmixer 104 is configured to generate a center channel (C) out of the two-channel stereo sources (i.e., (L) and (R) of the audio input 102), resulting in upmixed signals 106 left minus center (L−C), center (C), and right minus center (R−C), as shown. Further details of the operation of the upmixer 104 are discussed below with regard to center channel extraction in the context of FIG. 6.

The loudspeaker 100 may also include a loudspeaker beamformer 108. The loudspeaker beamformer 108 may have three inputs configured to receive the upmixed signals 106 (L−C), (R−C), and (C) from the upmixer 104. The loudspeaker beamformer 108 may also be connected to an L array of loudspeakers 110 (typically L=6 . . . 8). Each input channel (L−C), (R−C), and (C) corresponds to an acoustic beam of defined beam width.

Figure 2:
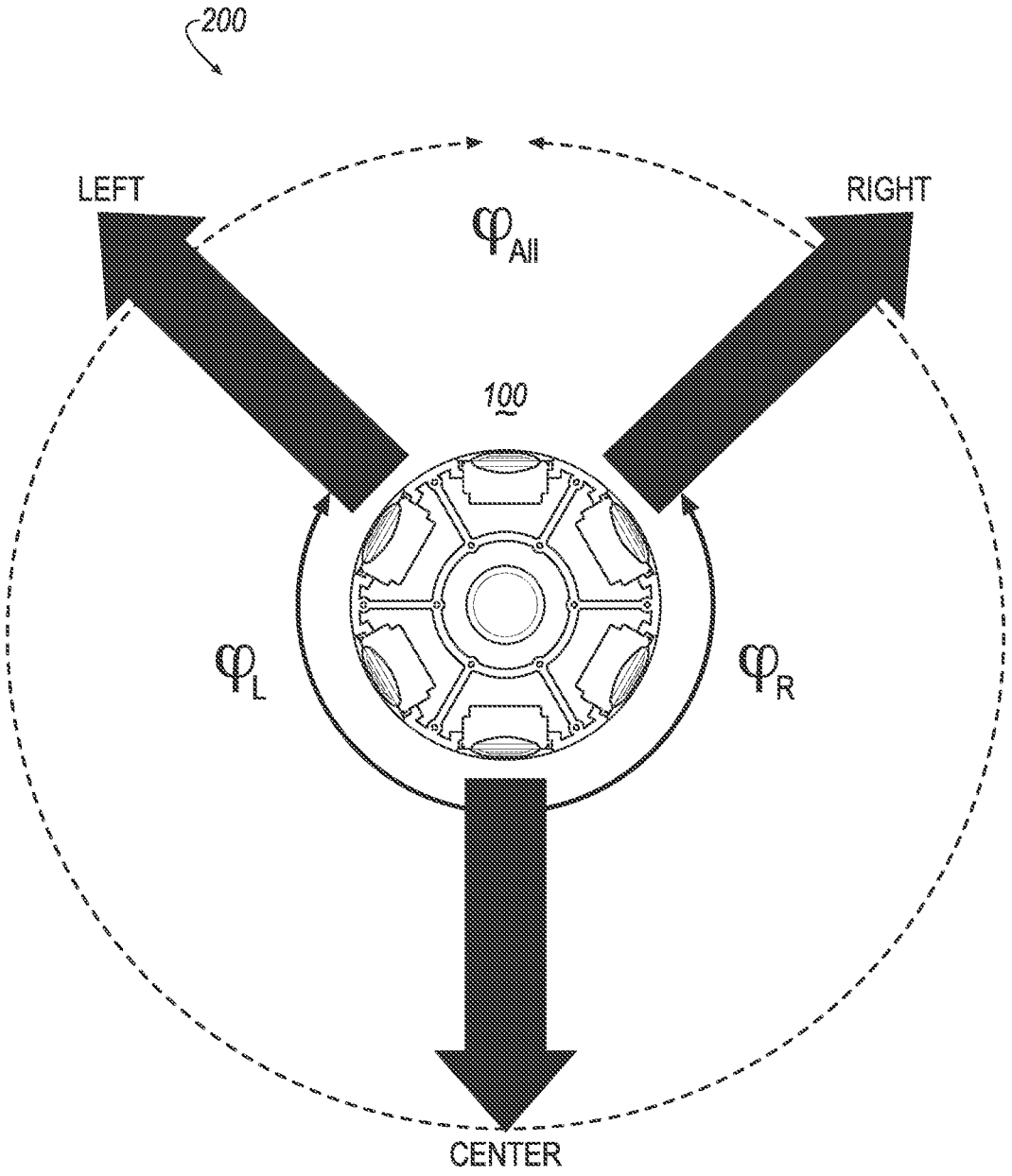
FIG. 2 illustrates an example three beam application using the smart loudspeaker.

FIG. 2 illustrates an example 200 three beam application using the smart loudspeaker 100. Three control angles of $\alpha L$, $\alpha R$ and $\alpha C$ define the pointing directions of the beams. Typically, the center (C), containing dialogue and lead performers, will be directed towards the listener, while the stereo channels are sent towards room walls, so that reflected sound reaches the listener, creating a sense of sound immersion and the desired stereo image width and depth. The stereo angles $\alpha L$, $\alpha R$ can be adjusted individually to maximize the stereo effect, while the entire sound stage, all angles simultaneously, can be rotated towards the listener via angle $\alpha ALL$.

Referring back to FIG. 1, the loudspeaker 100 may additionally include an array of M microphones 112, arranged in a circle (typically M=4 . . . 8 microphones). Microphone signals 114 from the microphones 112 may be received by an in-situ, microphone auto calibration stage 116. Calibrated signals 118 from the auto calibration stage 116 may be provided to a microphone beamformer 120, configured to deliver a speech output signal 122 suitable for a speech recognition engine (not shown) based on a microphone angle $\alpha M$ 124.

The loudspeaker 100 also includes a two input/one output adaptive acoustic echo canceller (AEC) filters 126. An AEC output signal 128 approximates the music signal that the microphones 112 receive, originating from input channels 102 (L) and (R), and reaching the microphones 112 from the loudspeakers 110 via both direct and indirect (room reflection) paths. By subtracting this signal 128 from the microphone signals 114, the music will be suppressed, and only the intended speech signal will be heard.

Figure 3A:
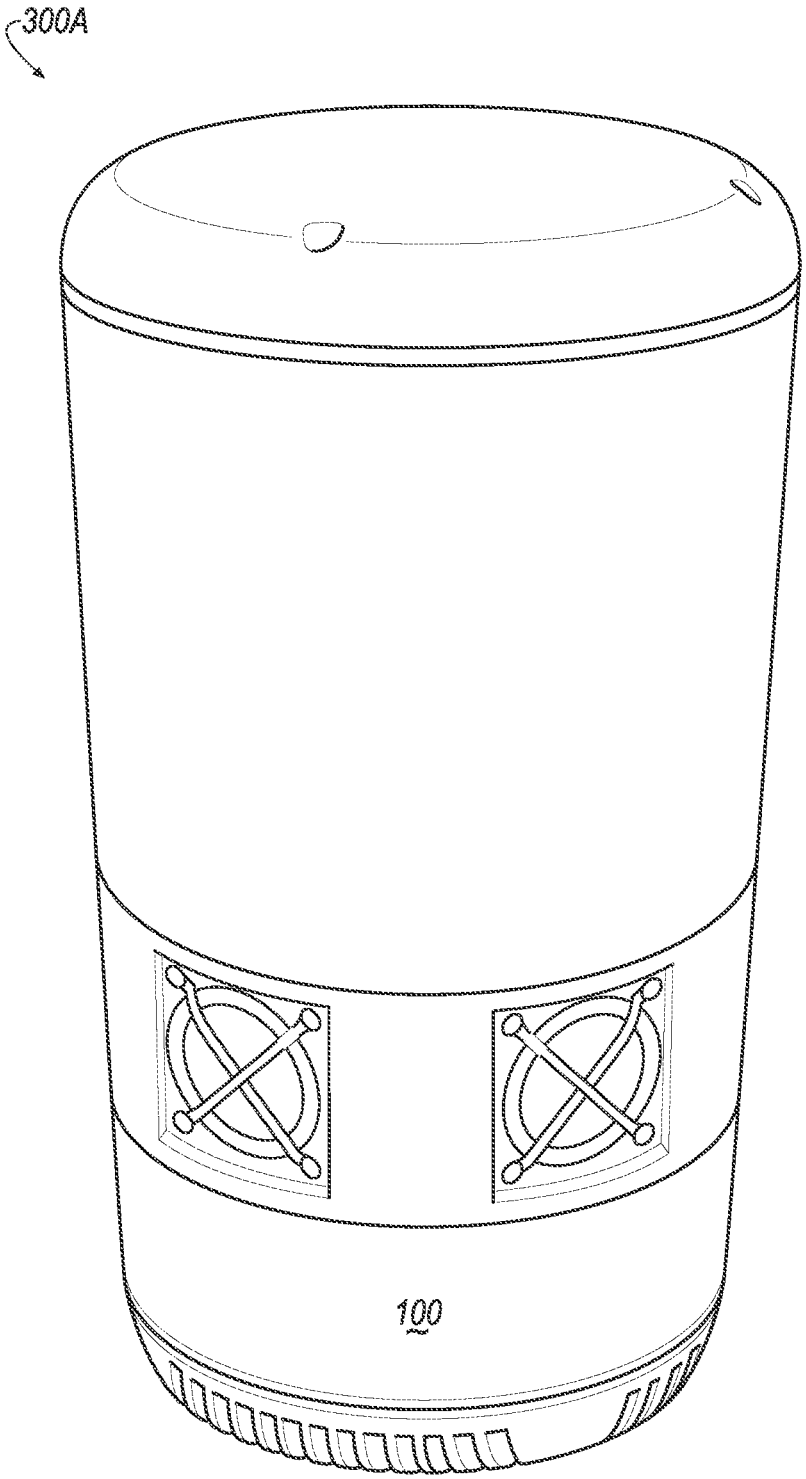
FIG. 3A illustrates a view of an example smart loudspeaker.
Figure 3B:
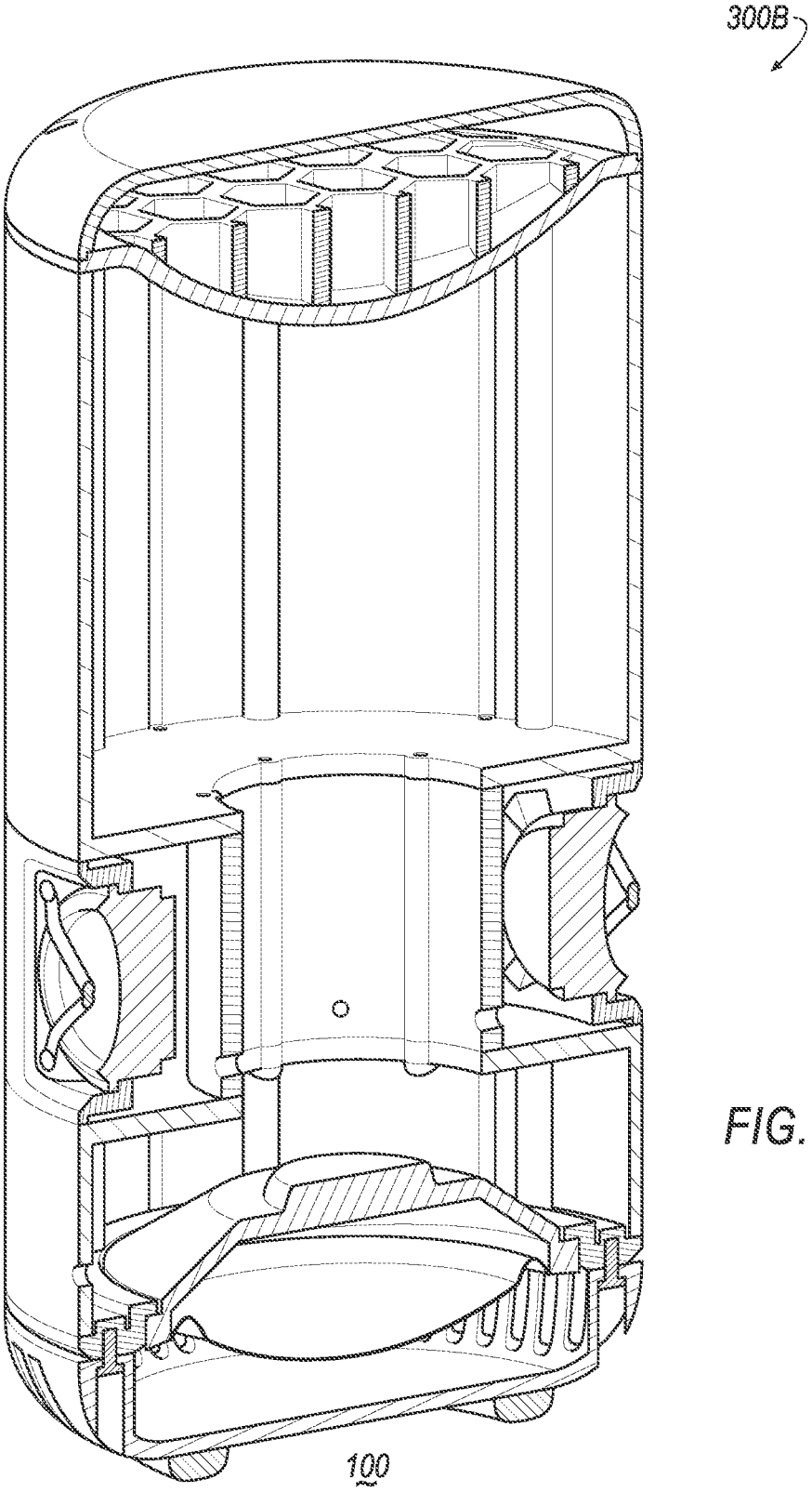
FIG. 3B illustrates a cutaway view of an example smart loudspeaker.

FIG. 3A illustrates an example view 300A of an example smart loudspeaker 100. FIG. 3B illustrates a cutaway view 300B of an example smart loudspeaker 100. In each of FIGS. 3A and 3B, the example smart array loudspeaker 100 includes six tweeters built into a cylindrical enclosure, regularly spaced at angle increments of 60°, and a downwards firing woofer. It should be noted that tweeter arrays having different numbers of devices may be used in other examples.

Figure 4:
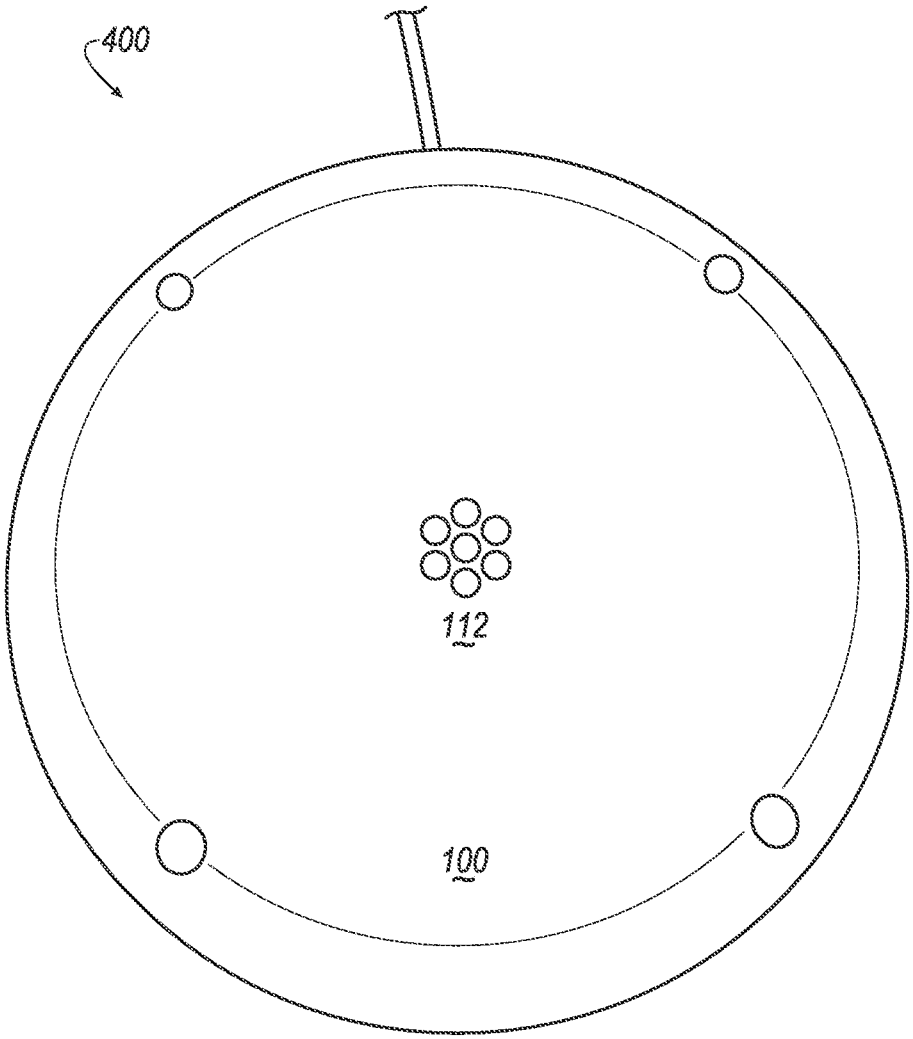
FIG. 4 illustrates a view of an example seven-channel microphone array for the smart loudspeaker.

FIG. 4 illustrates a view of an example 400 seven-channel microphone array 112 for the smart loudspeaker 100. The microphone array 112 may be built into the center of a top cover of the loudspeaker 100 as shown. The array 112 shown includes six closely spaced microphones arranged in a circle, and an optional center microphone. Examples without the center microphone, or with more or fewer microphones in the microphone array 112 may be used.

The microphone diameter may be small, e.g., with a diameter typically 10 millimeters. This allows the AEC 126 for the system to be simplified greatly. In other systems, the microphones may be placed in a circular arrangement of typically 4-10 centimeters (cm). This approach would require separate AEC filter pairs for each microphone of the array 112, because acoustic responses vary significantly with increasing distance. By reducing the diameter of the microphone array 112, processing power for performing AEC can be cut by a factor of M (i.e., the number of microphones) by applying only one AEC filter pair instead of M pairs. Reference for the AEC can be either the center microphone signal, or a signal obtained by averaging over the M array microphones 112 along the circle.

Figure 5:
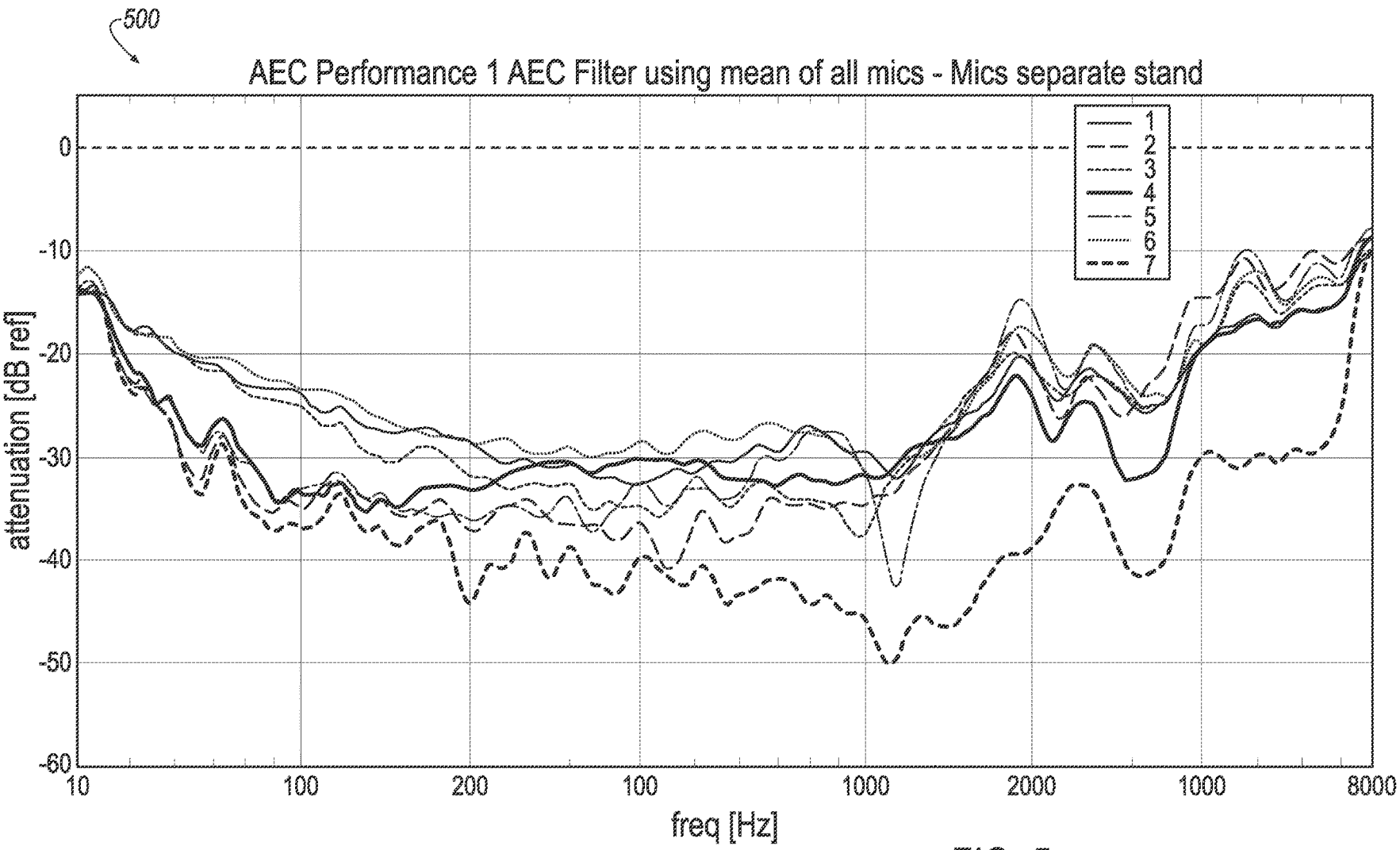
FIG. 5 illustrates an example graph of performance of a single AEC filter at array microphones as compared to the reference microphone.

FIG. 5 illustrates an example graph 500 of performance of a single AEC filter at various array microphones 112 as compared to the reference microphone. The graph 500 shows, for each microphone of the microphone array 112, attenuation in dB on the Y-axis across a frequency range shown on the X-axis. A wide-band degradation of AES performance at microphone positions 1 . . . 6 of less than 10 dB is observed, as compared with the reference position 7. Accordingly, the example graph 500 shows the effectiveness of this method.

Figure 6:
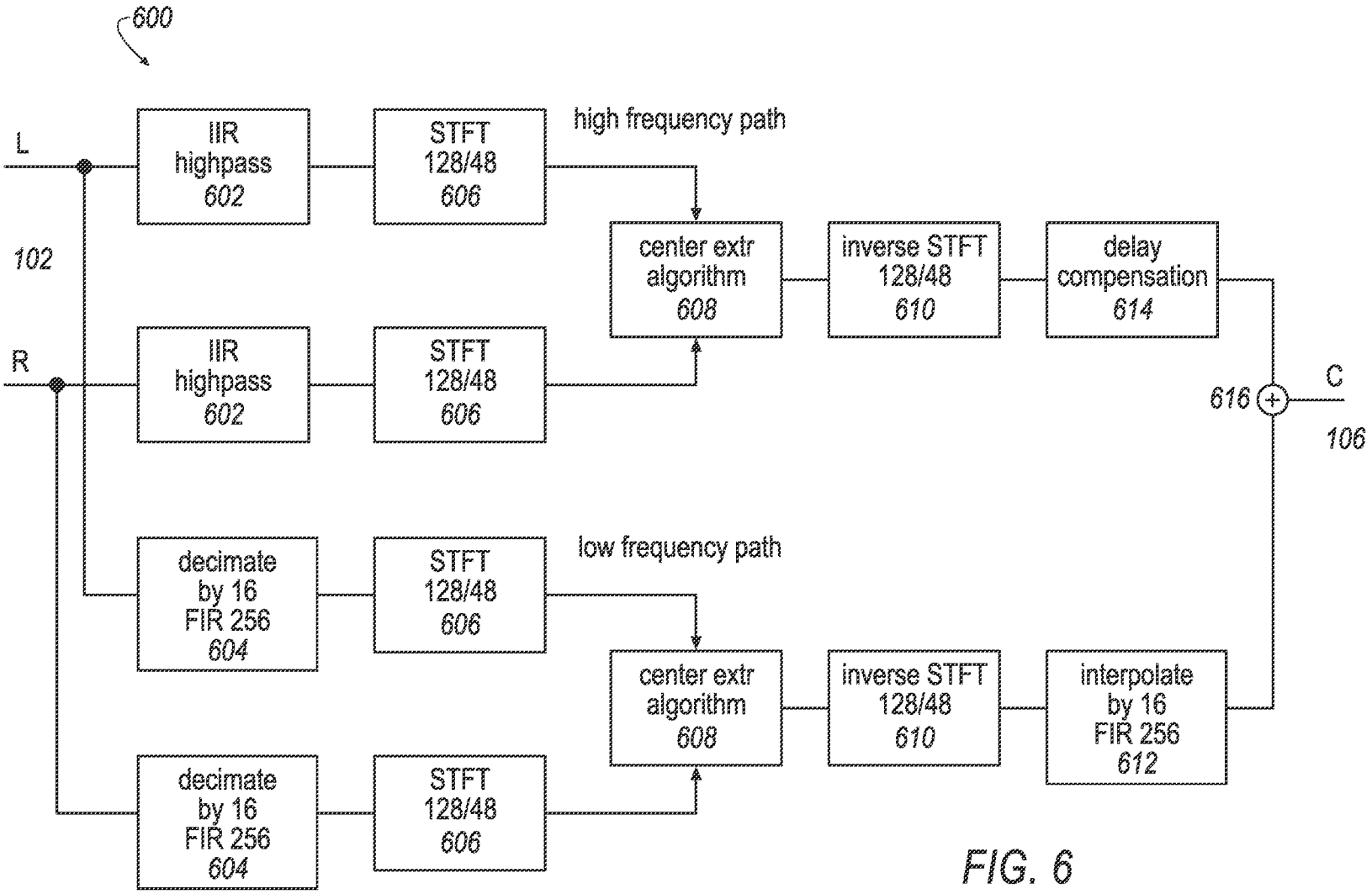
FIG. 6 illustrates an example block diagram of a center extraction functionality of the upmixer of the smart loudspeaker shown in FIG. 1.

FIG. 6 illustrates an example block diagram 600 of a center extraction functionality of the upmixer 104 of the smart loudspeaker 100 shown in FIG. 1. Accordingly, FIG. 6 illustrates further details of the operation of the upmixer 104 to perform center channel extraction. Generally, the upmixer 104 receives the left (L) and right (R) channels of the audio input 102, and processes the inputs to generate a center channel (C) 106. As shown in FIG. 2, this center channel (C) 106 may be directed towards the listener, while the stereo channels (L) and (R) 102 are sent towards room walls.

Referring more specifically to FIG. 6, the audio input 102 having left (L) and right (R) channels is split into two paths, a high-frequency path and a low-frequency path. The high-frequency path begins with a low-order recursive Infinite Impulse Response (IIR) high pass filter 602 for each of the (L) and (R) channels. In an example, the IIR high pass filters 602 may be implemented as a second order Butterworth filter with a (−3 dB) roll off frequency of 700 . . . 1000 Hz. The low pass filter path may begin with a pair of Finite Impulse Response (FIR) decimation filters 604. In one nonlimiting example, the decimation filters 604 may decimate by 16.

The outputs of each of the high pass filters 602 and the low pass decimation filters 604 is provided to Short-Term Fourier Transform (STFT) blocks 606 using the two-way time/frequency analysis scheme. The upmixer 104 performs a two-way time/frequency analysis scheme that uses very short Fourier transform lengths of typically 128 with a hop size of 48, thereby achieving much higher time resolution than methods using longer lengths. A method that applies a single Fast Fourier Transform (FFT) of length 1024 may result in a time resolution of 10 . . . 20 milliseconds (msec), depending on overlap length. By using the short transfer length, time resolution is shortened by a factor of ten, which is now more closely related to human perception (e.g., 1 . . . 2 msec). Frequency resolution is not compromised but improved as well due to sub-sampling of the lower frequency band. Also, aliasing distortion, which can occur in poly-phase filter banks with nonlinear processing, is avoided. Thus, the two-way time/frequency analysis scheme leads to exceptional fidelity and sound quality with artifacts suppressed below audibility. Further aspects of the operation of the scheme are described in U.S. Patent Publication No. 2013/0208895 titled, "Audio Surround Processing System," which is incorporated herein by reference in its entirety.

The (L) and (R) outputs of the STFT blocks 606 of the high-frequency path are provided to a center extraction block 608. Similarly, the (L) and (R) outputs of the STFT blocks 606 of the low-frequency path are provided to another center extraction block 608.

Notably, the STFT block 606 and center extraction block 608 in the low-frequency path run at a reduced sample rate of typically $f_S/r_S$, with $f_S$=48 kHz, $r_S$=16. This results in an $r_s$-fold increase in low-frequency resolution, thus the same short STFT length of 128 can be used.

Recombination after respective center extraction processing in high-frequency paths and low-frequency paths is accomplished by inverse STFTs, interpolation from the reduced sample rate $f_S/16$ to the original sample rate $f_S$, and delay compensation at high frequencies, in order to match the higher latency due to FIR filtering of the low-frequency path. More specifically, each of the center extraction blocks 608 feeds into an independent inverse STFT block 610. The output of the inverse STFT block 610 in the low-frequency path feeds into a FIR interpolation filter 612, which may interpolate to account for the decimation performed at block 604. The output of the inverse STFT block 610 in the high-frequency path may then feed into a delay compensation block 614. The outputs of the FIR interpolation filter 612 and the delay compensation block 614 may then be combined using an adder 616, where the output of the adder 616 is the center output (C) channel 106.

More specifically referring to the algorithm implemented by the center extraction block 608 itself, the following values may be computed as follows:

$$P=[|V_L|^2+|V_R|^2]/2 \tag{1}$$

where P is the mean signal energy, $V_L$ is a complex vector of the short-term signal spectra of the (L) input channel 102 signal, and $V_R$ is a complex vector of the short-term signal spectra of the (R) input channel 102 signal;

$$V_X=|V_L V_R^*| \tag{2}$$

where $V_X$ represents the absolute value of cross spectral density; and $$p_c=V_X/P \tag{3}$$

where $p_c$ is a quotient computed as the ratio of the absolute value of the cross spectral density $V_X$ to the mean signal energy P. This quotient may be referred to as the "Time/Frequency Mask."

Using those values, a time average $\overline{p_c}$, of $p_c$ is recursively computed as a recursive estimate with an update coefficient α (typically $\alpha=0.2/r_s$). The time index i denotes the actual block number (e.g., i=i+1, where every hop size=48 samples). The operations may be expressed as follows:

$$\overline{p_c}[i]=(1-\alpha)\overline{p_c}[i-1]+\alpha\overline{p_c}[i] \tag{4}$$

The center signal is then extracted using a nonlinear mapping function F. The desired output signal is obtained by multiplying the sum of the inputs (as a mono signal) with a nonlinear function F of the mask $\overline{p_c}$. This function can be optimized for the best compromise between channel separation and low distortion. The operations may be expressed as follows:

$$Y_c=(V_L+V_R)\cdot F(\overline{p_c}) \tag{5}$$

Figure 7:
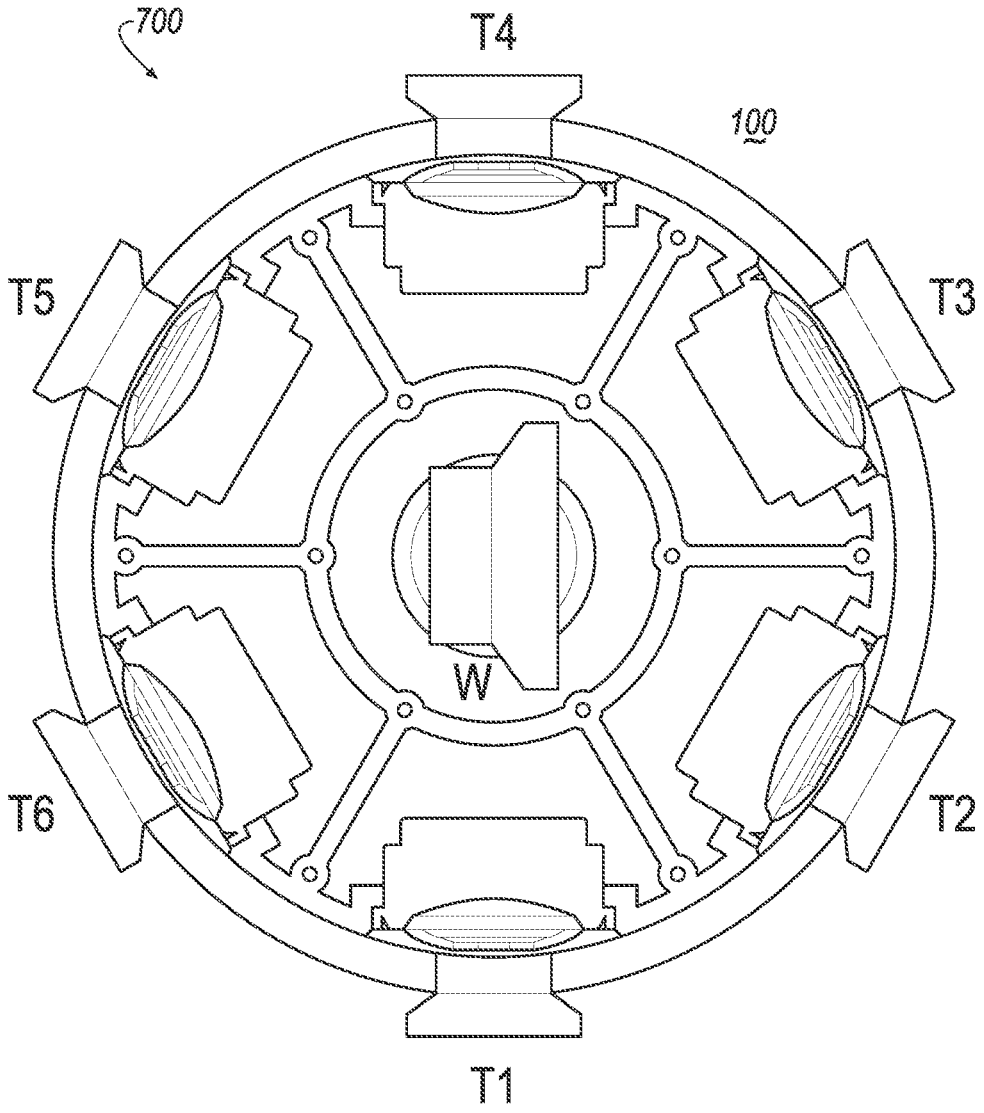
FIG. 7 illustrates an example of a six-speaker array along with a low-frequency driver.

FIG. 7 shows an example 700 of a beam forming design for the loudspeaker 100. As shown, six tweeters T1 . . . T6 are uniformly arranged around a circle, complemented by a woofer W that provides low frequency extension but no beam forming below the crossover frequency fC (typically 200 . . . 400 Hz, with fC=340 Hz in this example).

Figure 8:
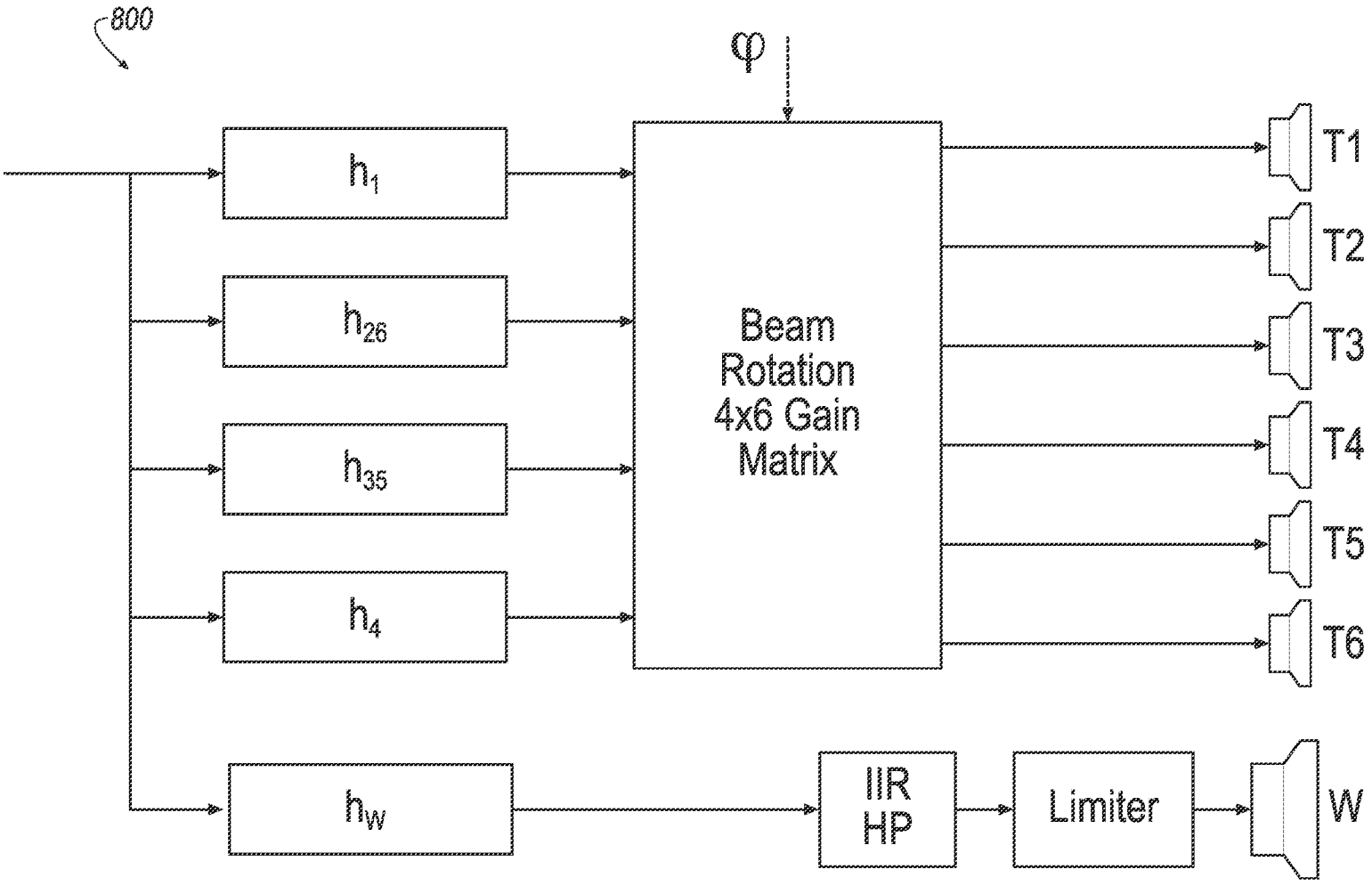
FIG. 8 illustrates an example system block diagram of beam forming filters and rotation matrix for mid-high frequency drivers as well as the signal path for the low-frequency driver.

FIG. 8 shows a system block diagram 800 of the beamformer 108 of the example loudspeaker 100 shown in FIG. 7. The block diagram 800 includes beam forming filters (h1, h26, h35, and h4) and a rotation matrix for mid-high frequency drivers, as well as the signal path for the low-frequency driver. As shown, tweeter T1 is connected to beam forming FIR (Finite Impulse Response) filter h1, both tweeters T2 and T6 to filter h26, tweeters T3 and T5 to filter h35, and T4 to filter h4. Notably, the pairs of tweeters may share the same filter, because of beam symmetry with respect to the main axis.

The beam can be rotated to any desired angle ϕ by re-assigning the tweeters. For example, rotation of ϕ=60° may be accomplished by connecting filter h1 to tweeter T2, h26 to tweeter pairs T1 and T3, and so on. Additionally, any angle in-between can be realized by linear interpolation of the respective tweeter signals. The rotation is realized as a 4×6 gain matrix, because there are four beam forming filters and six tweeters in this example. However, different numbers of filters and tweeters would affect the dimensions of the rotation matrix. Besides linear interpolation, other interpolation laws such as cosine or cosine squared may additionally or alternately be used.

Figure 9:
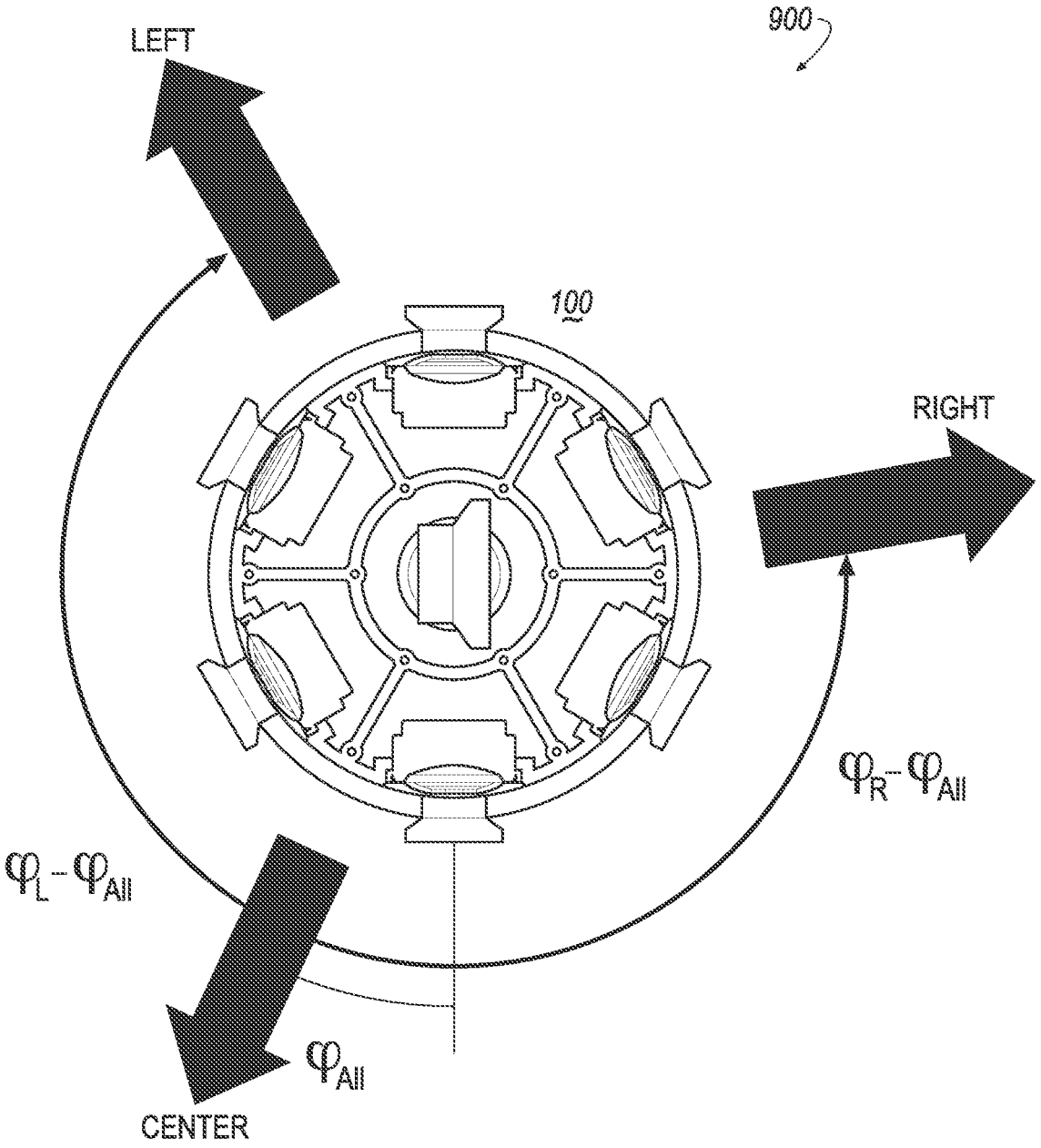
FIG. 9 illustrates an example rotation of a sound field using the smart loudspeaker.

FIG. 9 illustrates an example 900 rotation of a sound field using the smart loudspeaker 100. In a multichannel application, for example using the channels (L−C), (C), (R−C) as shown in FIG. 9, each channel connects to its own set of beam forming filters and rotation matrix. As compared to FIG. 2, in FIG. 9 the entire sound field is rotated by angle $\varphi_{All}$, while the (L) channel is rotated by $\varphi_L-\varphi_{All}$ and the (R) channel is rotated by $\varphi_R-\varphi_{All}$. To perform the rotations, a first beamforming filter and rotation matrix may be used for the (L−C) channel, a second beamforming filter and rotation matrix may be used for the (C) channel, and a third beamforming filter and rotation matrix may be used for the (R−C) channel.

Referring back to FIG. 8, the woofer processing path contains a crossover filter hW, an optional recursive (IIR) high pass filter to cut off frequencies below the woofer's operating range, and an optional limiter. The crossover filters can be designed as FIR filters to realize an acoustic linear phase system. Further aspects of the crossover filter are described in U.S. Pat. No. 7,991,170, titled "Loudspeaker Crossover Filter," which is incorporated herein by reference in its entirety.

Figure 10:
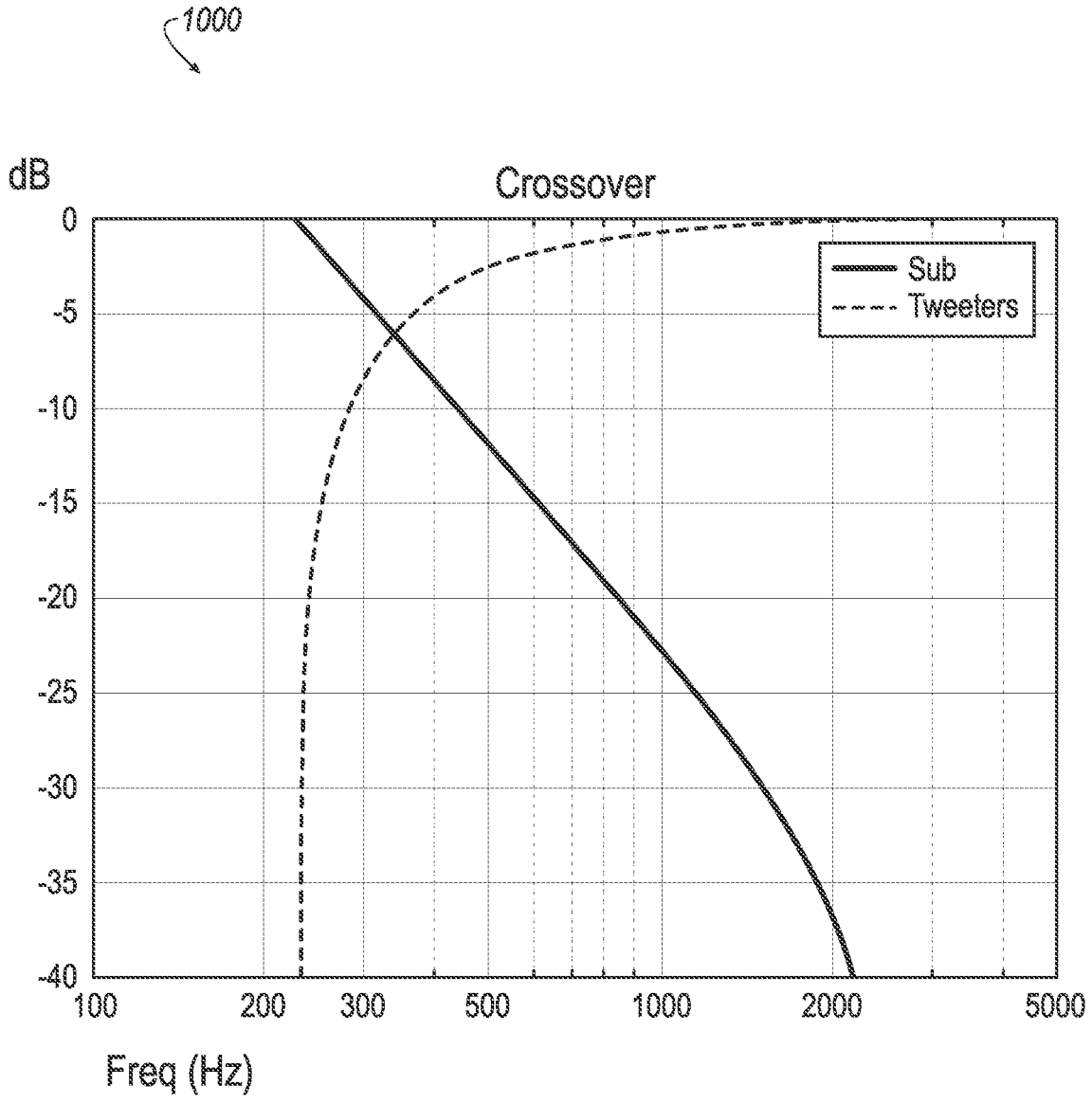
FIG. 10 illustrates example crossover filter frequency responses for the smart loudspeaker.

FIG. 10 illustrates an example 1000 crossover filter frequency response for the smart loudspeaker 100. In the example 1000 graph, the Y-axis represents decibels, while a frequency range is shown on the X-axis. As shown, the low frequency driver crosses over to the high-frequency drivers at around 340 Hz. Generally, the crossover filters are designed to equalize the measured speaker response with respect to the crossover target.

Figure 11:
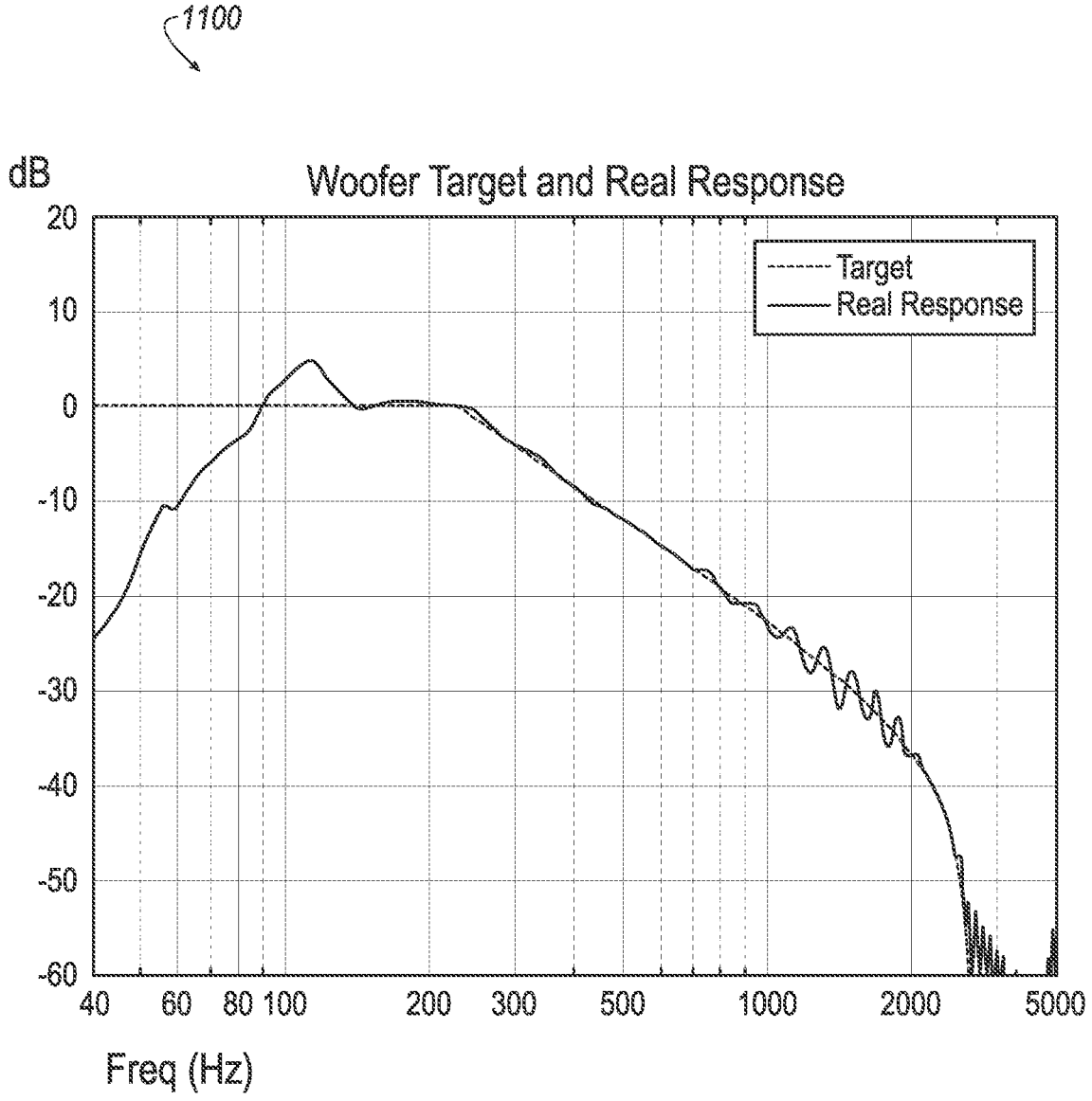
FIG. 11 illustrates an example approximation of low-frequency driver target response.

FIG. 11 illustrates an example 1100 approximation of low-frequency driver target response. In the example 1100 graph, the Y-axis represents decibels, while a frequency range is shown on the X-axis. Notably, the tweeter crossover high pass filters may be factored into the beam forming filters.

The design of beam forming filters may be based on acoustic data. In an example, impulse responses may be captured in an anechoic chamber. Each array driver may be measured at discrete angles around the speaker by rotation via a turntable. Further aspects of the design of the beamforming filters is discussed in further detail in International Application Number PCT/US17/49543, titled "Variable Acoustics Loudspeaker," which is incorporated herein by reference in its entirety.

The acoustic data may be preconditioned by computing complex spectra using the Fourier transform. Then, complex smoothing may be performed by computing magnitude and phase, separately smoothing magnitude and phase responses, then transforming the data back into complex spectral values. Additionally, angular response may be normalized to the spectrum of the frontal transducer at 0° by multiplying each spectrum with its inverse. This inverse response may be utilized later for global equalization.

Figure 12:
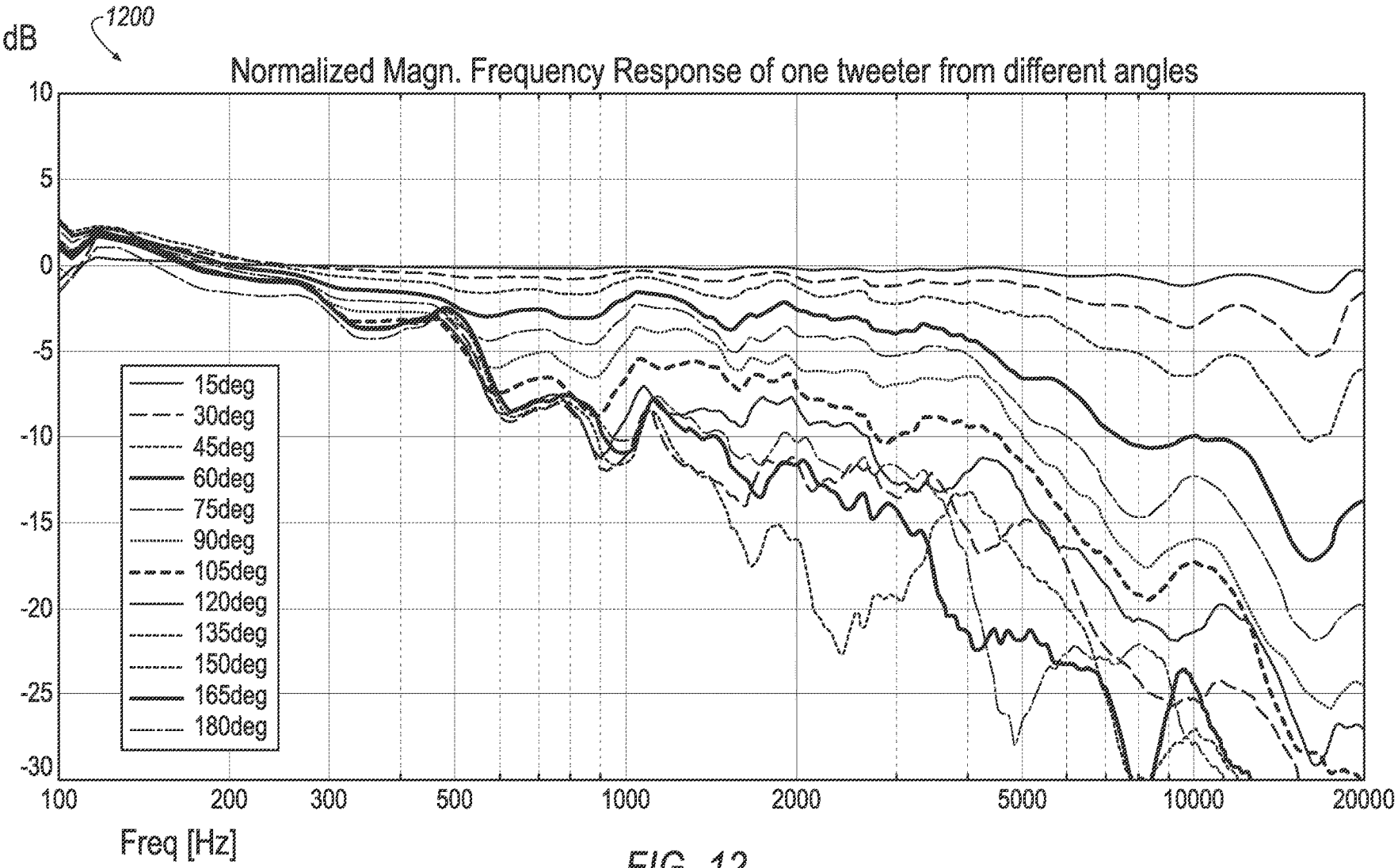
FIG. 12 illustrates an example high-frequency response for various angles around the smart loudspeaker.

FIG. 12 illustrates an example 1200 of high-frequency response for various angles around the smart loudspeaker 100. More specifically, the example 1200 shows magnitude responses of the frontal transducer, seen at angles 15° to 180° in 15° steps. In the example 1200 graph, the Y-axis represents decibels, while a frequency range is shown on the X-axis.

The measured, smoothed complex frequency responses can be written in matrix form as follows:

$$H_{sm}(i,j), i=1 \ldots N, j=1 \ldots M, \tag{6}$$

where the frequency index is i, N is the FFT length (N=2048 in the illustrated example), and M the number of angular measurements in the interval [0 . . . 180]° (M=13 for 15° steps in the illustrated example).

An array of R drivers (here R=6) includes one frontal driver at 0°, one rear driver at 180°, and P=(R−2)/2 driver pairs located at the angles $$\alpha_r = r\frac{180°}{P+1}, r = 1, \ldots, P.$$

The design of P beam forming filters $C_r$ is such that they are connected to the driver pairs where an additional filter $C_{P+1}$ is provided for the rear driver. First, as stated above, the measured frequency responses are normalized at angles greater than zero with respect to the frontal response to eliminate the driver frequency response. This normalization may be factored back in later when designing the final filter in form of driver equalization, as follows:

$$H_0(i)=H_{sm}(i,1);$$

$$H_{norm}(i,j)=H_{sm}(i,j)/H_0(i), i=1 \ldots N, j=1 \ldots M \tag{7}$$

The filter design iteration works for each frequency point separately. The frequency index may be eliminated for convenience, as follows:

$$H(\alpha_k):=H_{norm}(i,k) \tag{8}$$

as the measured and normalized frequency response at discrete angle $\alpha_k$.

Assuming a radial-symmetric, cylindrical enclosure and identical drivers, the frequency responses U(k) of the array may be computed at angles $\alpha_k$ by applying the same offset angle to all driver as follows:

$$U(k) = H(\alpha_k) + \sum_{r=1}^{P} C_r \cdot \{H(\langle\alpha_k + \alpha_r\rangle) + H(\langle\alpha_k - \alpha_r\rangle)\} + C_{P+1} \cdot H(\langle\alpha_k + 180°\rangle), \tag{9}$$

$$\langle\alpha\rangle := \begin{cases} |\alpha|, & -180° < \alpha < 180° \\ 360° - \alpha, & \alpha > 180° \end{cases}.$$

The spectral filter values $C_r$ can be obtained iteratively by minimizing the quadratic error function:

$$e = \sqrt{\sum_{k=1}^{Q} w(k)(|U(k)/a| - t(k))^2}. \tag{10}$$

where t(k) is a spatial target function, specific to the chosen beam width, as defined later.

The parameter α defines the array gain:

$$\alpha_{gain}=20\cdot\log(\alpha)$$

The array gain specifies how much louder the array plays compared to one single transducer. It should be higher than one, but cannot be higher than the total transducer number R. In order to allow some sound cancellation that is necessary for super-directive beam forming, the array gain will be less than R but should be much higher than one. In general, the array gain is frequency dependent and must be chosen carefully to obtain good approximation results.

Additionally, Q is the number of angular target points (for example Q=9). Also, w(k) is a weighting function that can be used if higher precision is required in a particular approximation point versus another (usually 0.1<w<1).

The variables to be optimized are the P+1 complex filter values per frequency index i, $C_r$ (i), r=1 . . . (P+1). The optimization may be started at the first frequency point in the band of interest $$i = i_1 = \left\lfloor \frac{f_1}{f_g} N \right\rfloor$$

(for example $f_1$=100 Hz, $f_g$=24 KHz, N=2048=<$i_1$=8), set $C_r$=1 ∀r as a start solution, then subsequently compute the filter values by incrementing the index each time until reaching the last point $$i = i_2 = \left\lceil \frac{f_2}{f_g} \cdot N \right\rceil (e.g.\ \ f_2 = 12\ \text{KHz} = > i_2 = 1024).$$

Instead of real and imaginary part, use of magnitude $|C_r(i)|$ and unwrapped phase $\arg(C_r(i)=\arctan(\mathrm{Im}\{C_r(i)\}/\mathrm{Re}\{C_r(i)\})$ can be used for the nonlinear optimization routine as variables.

This bounded, nonlinear optimization problem can be solved with standard software, for example the function "fmincon", which is part of the Matlab optimization toolbox. The following bounds may be applied:

$$G_{max}=20*\log(\max(|C_r|))$$

The maximum allowed filter gain, and lower and upper limits for the magnitude values from one calculated frequency point to the next to be calculated point, specified by an input parameter δ, as follows:

$$|C_r(i)|\cdot(1-\delta)<|C_r(i+1)|<|C_r(i)|\cdot(1+\delta) \quad (12)$$

in order to control smoothness of the resulting frequency response.

Design examples using an array diameter of 150 millimeters, with 6 mid/tweeters crossed over at 340 Hz are discussed as follows.

Figure 13:
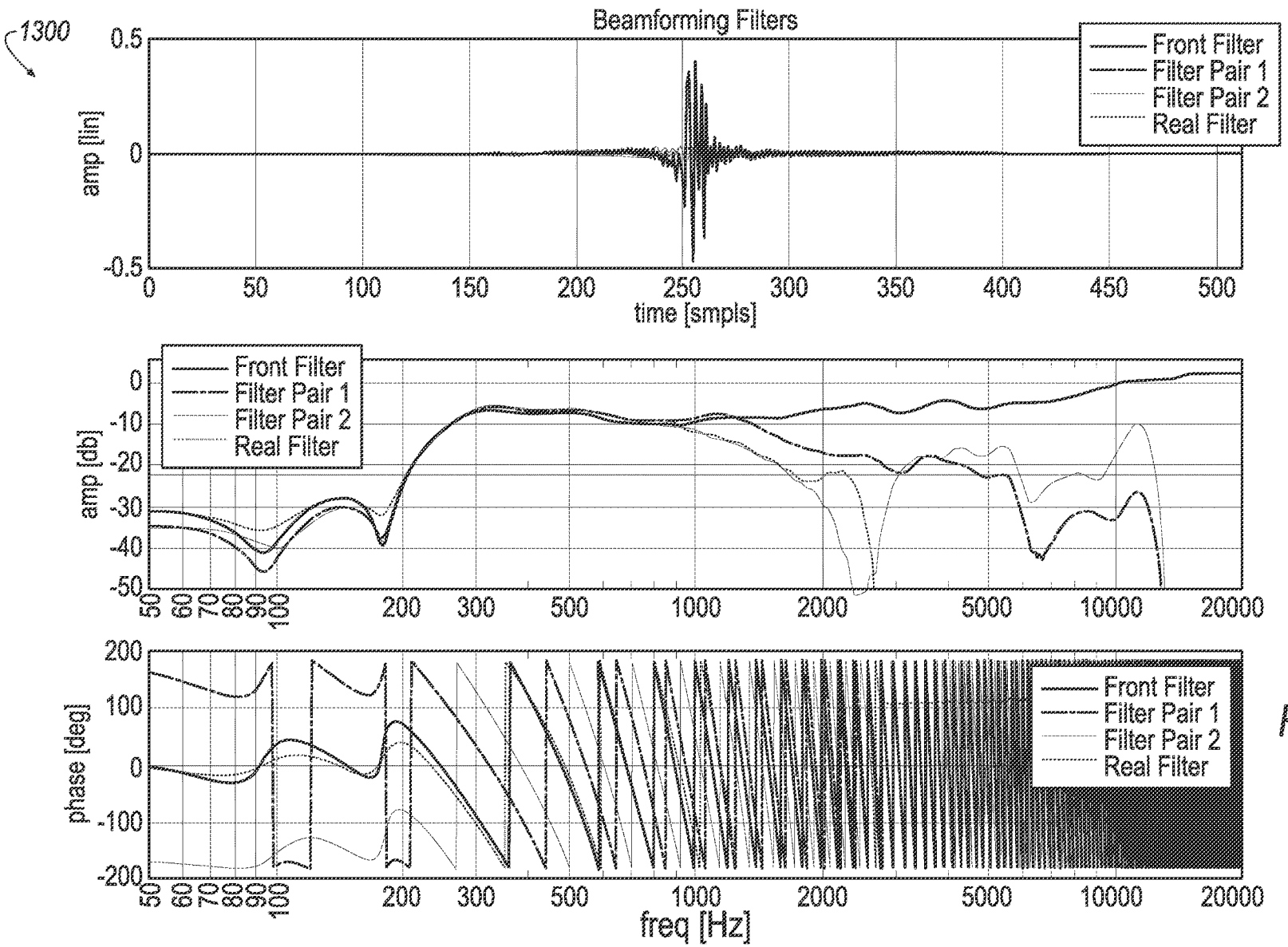
FIG. 13 illustrates combined transducer filters, impulse responses, magnitude responses, and phase for the smart loudspeaker.
Figure 14:
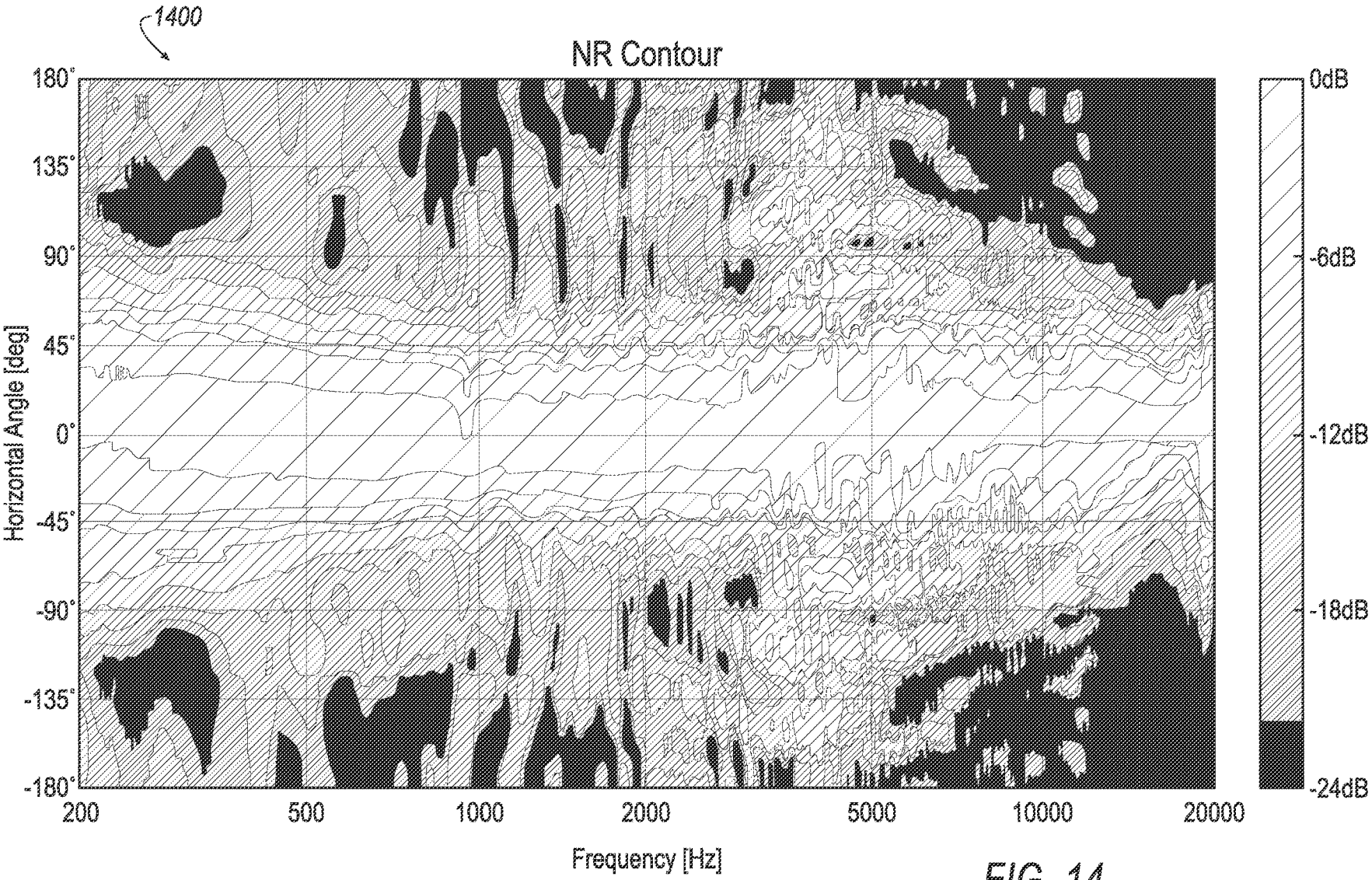
FIG. 14 illustrates an example contour plot of a forward beam using the smart loudspeaker in a narrow beam configuration.

In a narrow beam example, FIGS. 13-14 show results utilizing the loudspeaker 100 of FIG. 1. The parameters for the narrow beam example are as follows:

| | |
|---|---|
| Target function at | $t_k$ = [−1.5 −3.5 −8 −12 −15 −18 −20 −20], $\alpha_k$ = [15 30 45 60 90 120 150 180]° |
| Number of drivers | R = 6 |
| Number of driver pairs | P = 2 |
| Calculated beam forming filters | $C_1$, $C_2$, $C_3$ |
| Array gain | 12 dB, f < 1 kHz; 4 dB, f > 3.0 kHz; −3 dB, f > 7.5 kHz. The two bands in-between are transition bands with linearly decreasing array gains from the previous to the new value. |
| Max. filter gain | $G_{max}$ = 5 dB |
| Smoothing bound | δ = 1.0 |

FIG. 13 illustrates optimization results 1300 for the narrow beam example. These results include combined transducer filters, impulse responses, magnitude responses, and phase for the smart loudspeaker 100. The filters include beam forming, crossover, and driver EQ. As shown, the filters are smooth, do not exhibit much time dispersion (preringing), and require very limited low frequency gain, which is important to achieve sufficient dynamic range.

FIG. 14 shows a contour plot 1400 of the forward beam in the narrow beam configuration. Constant directivity throughout the entire frequency band 100 Hz . . . 20 kHz is achieved to a high degree, except for some minor artifacts at around 4-5 kHz, which are barely audible.

Figure 15:
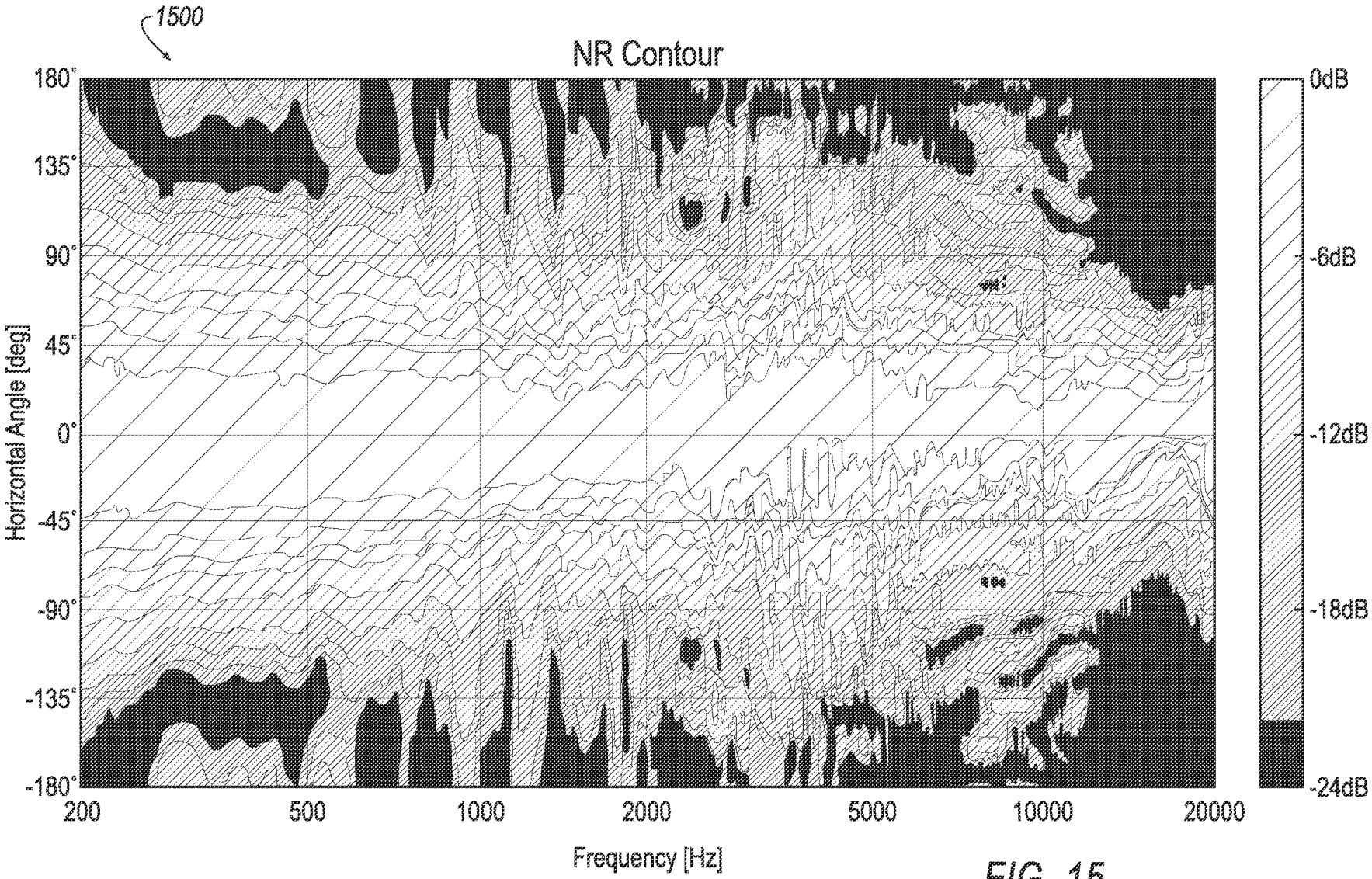
FIG. 15 illustrates an example contour plot of a forward beam using the smart loudspeaker in a medium beam configuration.

FIG. 15 show a contour plot 1500 utilizing the loudspeaker 100 of FIG. 1 in a medium-wide beam configuration. The parameters for the medium-wide beam example are as follows:

| | |
|---|---|
| Target function at | $t_k$ = [0 −1.5 −3 −5 −10 −15 −20 −25], $\alpha_k$ = [15 30 45 60 90 120 150 180]° |
| Number of drivers | R = 6 |
| Number of driver pairs | P = 2 |
| Calculated beam forming filters | $C_1$, $C_2$, $C_3$ |
| Array gain | 12 dB, f < 1 kHz; 0 dB, f > 3.0 kHz; −2 dB, f > 7.5 kHz. The two bands in-between are transition bands with linearly decreasing array gains from the previous to the new value. |
| Max. filter gain | $G_{max}$ = 5 dB |
| Smoothing bound | δ = 0.5 |

The contour plot of the medium-wide beam is shown in FIG. 15.

The loudspeaker 100 may further be utilized in an omni-directional mode. For monaural sources, such as speech, an omni-directional mode with a dispersion pattern as uniform and angle-independent as possible is often required. First, a wide-beam design is approached with the same method:

| | |
|---|---|
| Target function at | $t_k$ = [0 0 0 −2 −4 −5 −6 −6], $\alpha_k$ = [15 30 45 60 90 120 150 180]° |
| Number of drivers | R = 6 |
| Number of driver pairs | P = 2 |
| Calculated beam forming filters | $C_1$, $C_2$, $C_3$ |
| Array gain | 8 dB, f < 1 kHz; 3 dB, f > 3.0 kHz; 2 dB, f > 10 kHz. The two bands in-between are transition bands with linearly decreasing array gains from the previous to the new value. |
| Max. filter gain | $G_{max}$ = 0 dB |
| Smoothing bound | δ = 0.2 |

Figure 16:
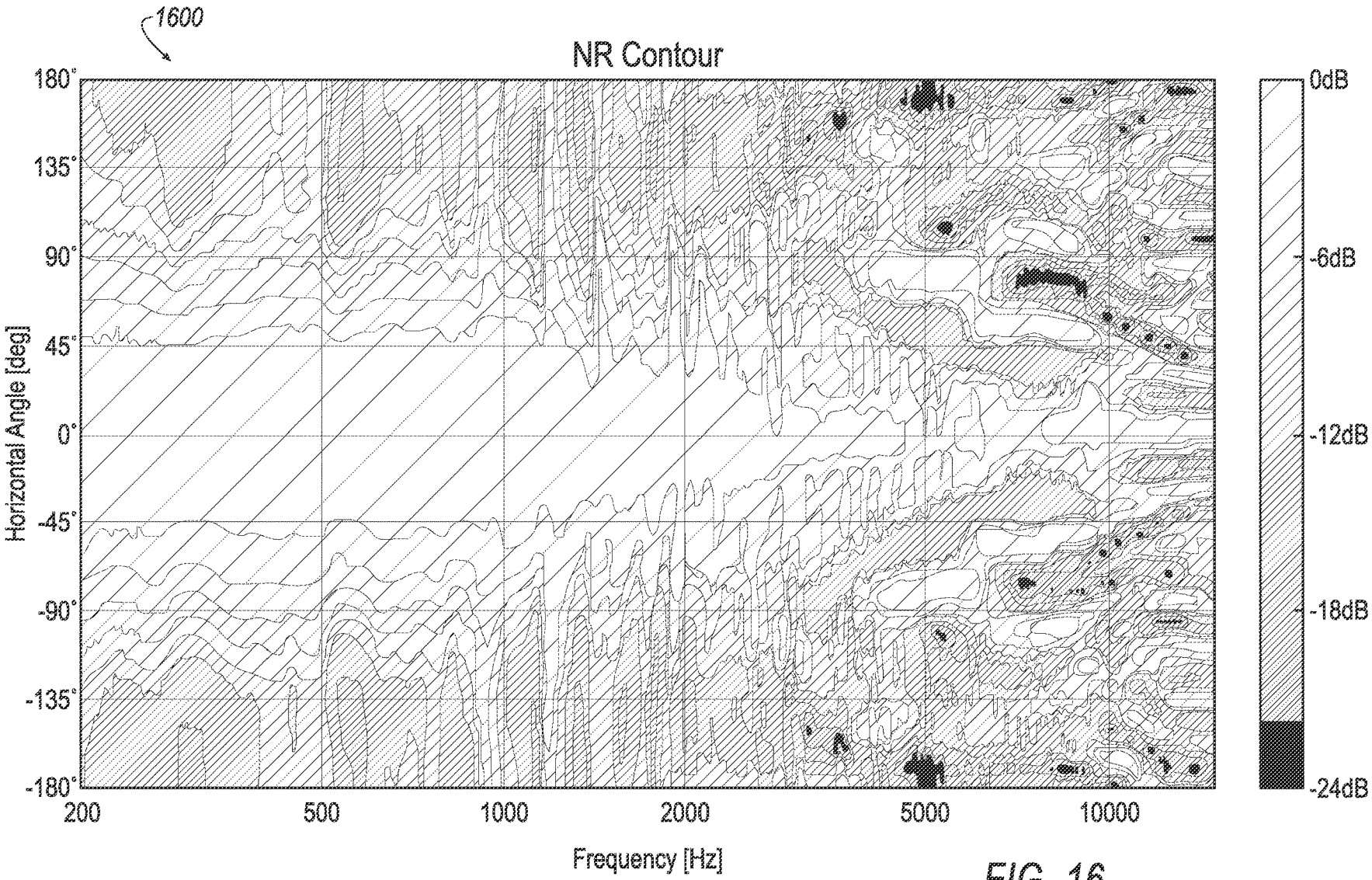
FIG. 16 illustrates an example contour plot of a forward beam using the smart loudspeaker in an omni-directional beam configuration.

FIG. 16 illustrates an example 1600 of a contour plot of a forward beam using the smart loudspeaker 100 in an omni-directional beam configuration. As shown, the FIG. 16 indicates results showing that the omni-directional goal has only been partly achieved, as there is still a noticeable main beam direction with artifacts above 4 kHz due to spatial aliasing.

Figure 17:
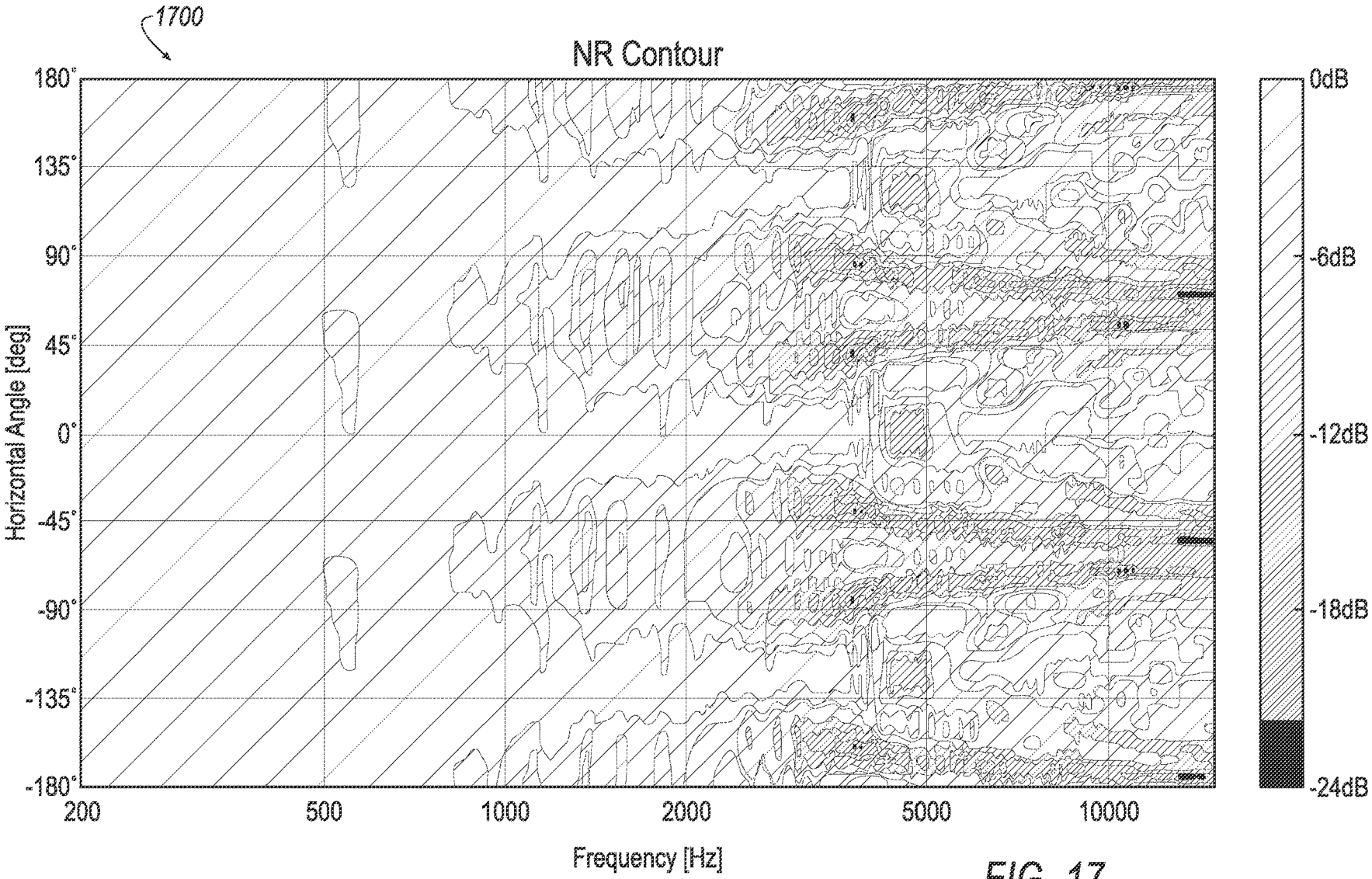
FIG. 17 illustrates an example contour plot of a forward beam using the smart loudspeaker in an omni-directional beam configuration utilizing three medium beam configurations.

FIG. 17 illustrates an example 1700 of a contour plot of a forward beam using the smart loudspeaker 100 in an omni-directional beam configuration utilizing three medium beam configurations. As shown in FIG. 17, a better result can be reached by using three of the previously shown "medium-wide" beams, pointing at 0° and +/−120°, respectively.

Referring to the steerable microphone array 112, the microphone beamformer 120 may be designed in three stages, initial and in-situ calibration, closed-form start solution, and optimization to a target.

Regarding microphone auto-calibration, low-cost Electret Condenser Microphones (ECM) and Microelectromechanical system (MEMS) microphones usually exhibit a deviation of typically +/−3 dB from a mean response. This is confirmed by the example of FIG. 18, which shows measured, far field responses of six ECM microphones arranged on a circle of 10 millimeters in diameter (e.g., in the arrangement shown in FIG. 4). Since low-frequency beam forming relies on microphone difference signals, which are small where wave length is large compared to the diameter, very high precision is required.

Figure 18:
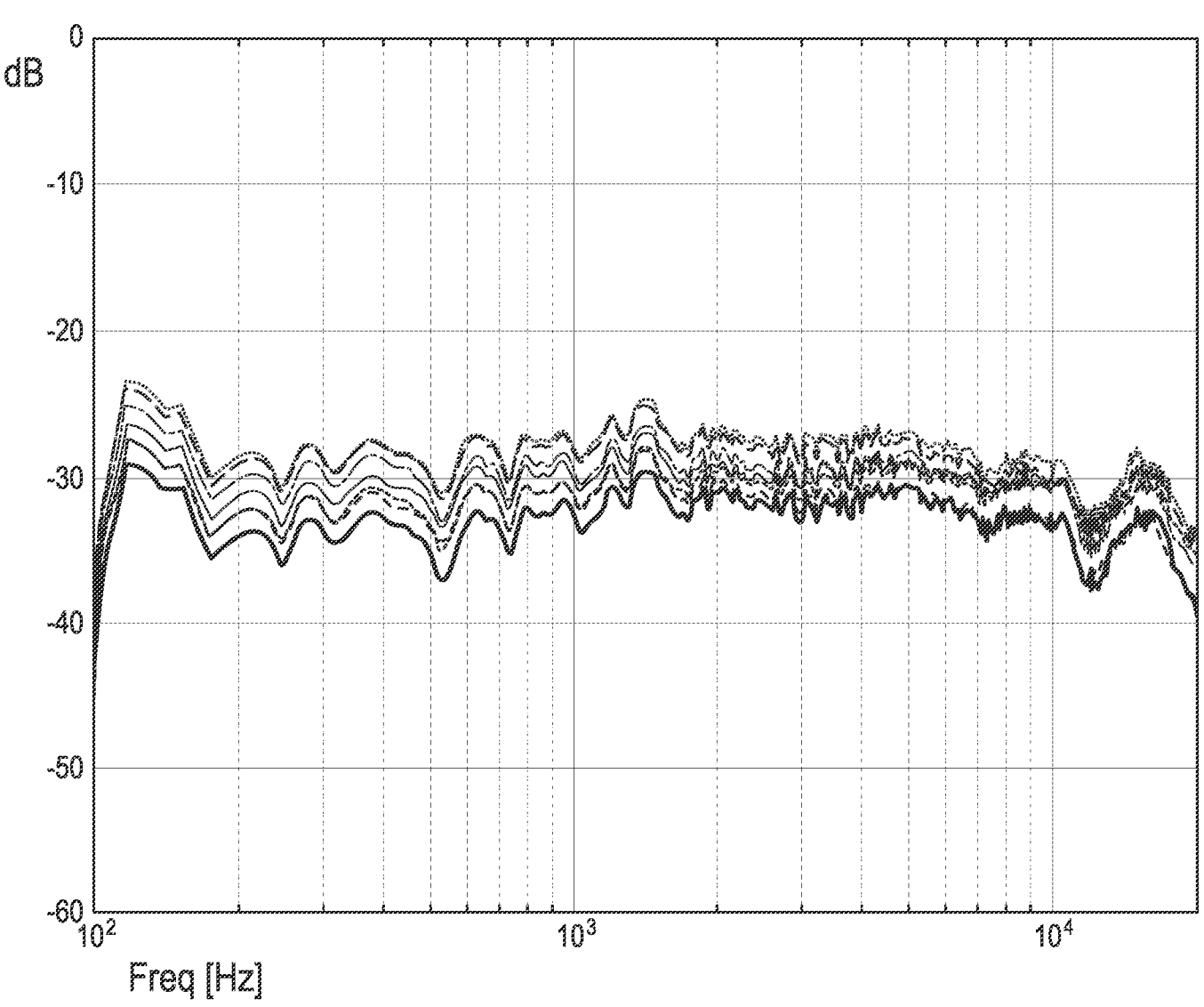
FIG. 18 illustrates an example of frequency response of microphones of the microphone array before calibration.

FIG. 18 illustrates an example 1800 of frequency response of microphones of the microphone array before calibration. An initial calibration is performed by convolving each microphone's signal with a minimum phase correction filter, the target of which is one of the microphones. Choice of reference is arbitrary—it could be the (optional) center microphone, or the frontal one. The filter design method is performed in the frequency log-domain, and minimum phase impulse responses derived by Hilbert transform, a method known to DSP designers. A FIR filter length of 32 is sufficient, because below about 1 kHz the deviations between the microphones are mainly due to a frequency independent gain error.

Figure 19:
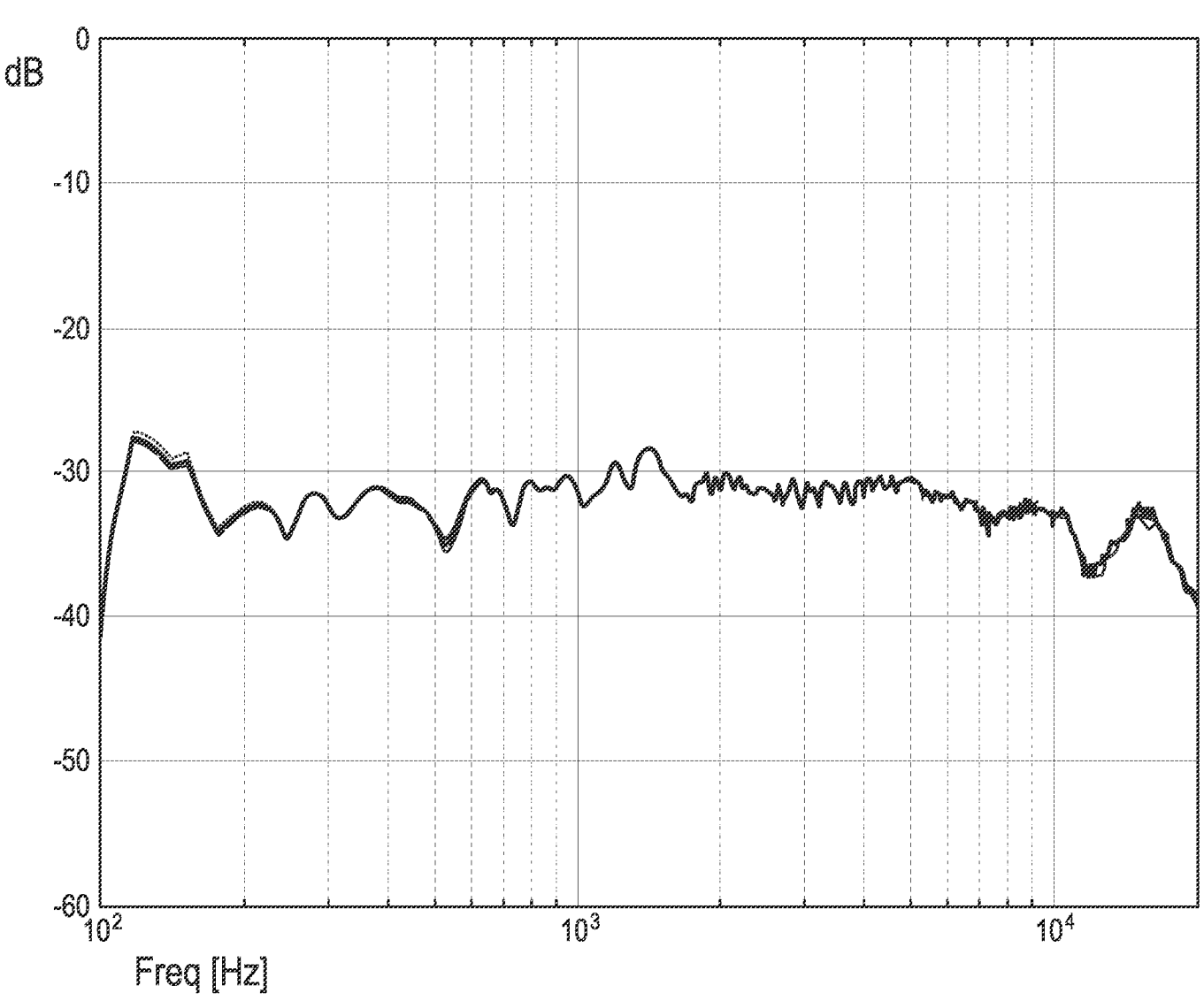
FIG. 19 illustrates an example of frequency response of microphones of the microphone array after calibration.

FIG. 19 illustrates an example 1900 of frequency response of microphones of the microphone array after calibration.

In order to accommodate for microphone aging or environmental conditions such as temperature and humidity, in-situ calibration is required from time to time. This can be accomplished by estimating the response of the reference microphone over time with the music being played, or a dedicated test signal, then equalizing the other microphones to that target.

Regarding the initial beamforming solution, closed solutions exist for circular microphone arrays 112 in free air. A well-known design may be used to obtain a start solution for subsequent nonlinear optimization. The textbook by Jacob Benesty, "Design of Circular Differential Microphone Arrays," Springer 2015 is incorporated by reference in its entirety, and describes that the microphone beam forming filter vector H=[H1 . . . Hm] can be computed as follows:

$$H = \frac{[\Gamma_{dn} + \varepsilon I]^{-1} D}{D^H [\Gamma_{dn} + \varepsilon I]^{-1} D}, \tag{13}$$

where $$\Gamma_{dn} = \mathrm{sinc}\left(\frac{\omega \delta_{ij}}{c}\right)$$

representing a "pseudo coherence matrix" for diffuse noise;
I is a unity matrix;
ω is frequency;
c is the speed of sound;
the distances between microphones i and j are:

$$\delta_{ij} = d\left|\sin\frac{\pi(i-j)}{M}\right|$$

where d is the array diameter;
D=[D1 . . . Dm] denotes the steering vector, where $$\tau_m = \frac{d/2}{c}\cos(\varphi_m)\ m = 1\ldots M,\ \varphi_m = \text{microphone angles}$$

ε is a regularization factor. In this example ε=1e−5.

The delay vector V=[V1 . . . VM] of an ideal, circular array of point sensors at the angle θ may be defined as:

$$V(\theta) = [e^{-j\omega\tau_1} \ldots e^{-j\omega\tau_M}],\ \tau_m = \frac{d/2}{c}\cos(\theta - \varphi_m). \tag{14}$$

We obtain the complex response $B_m$ of microphone m at angle θ by cascading above delay $V_m$, beam filter $H_m$, and conjugate complex steering vector element $D_m$ as:

$$B_m(\theta) = V_m(\theta) H_m D_m^*, \tag{15}$$

and finally the beam response U(θ) by complex summation over the individual responses:

$$U(\theta) = \sum_{m=1}^{M} B_m(\theta). \tag{16}$$

Figure 20:
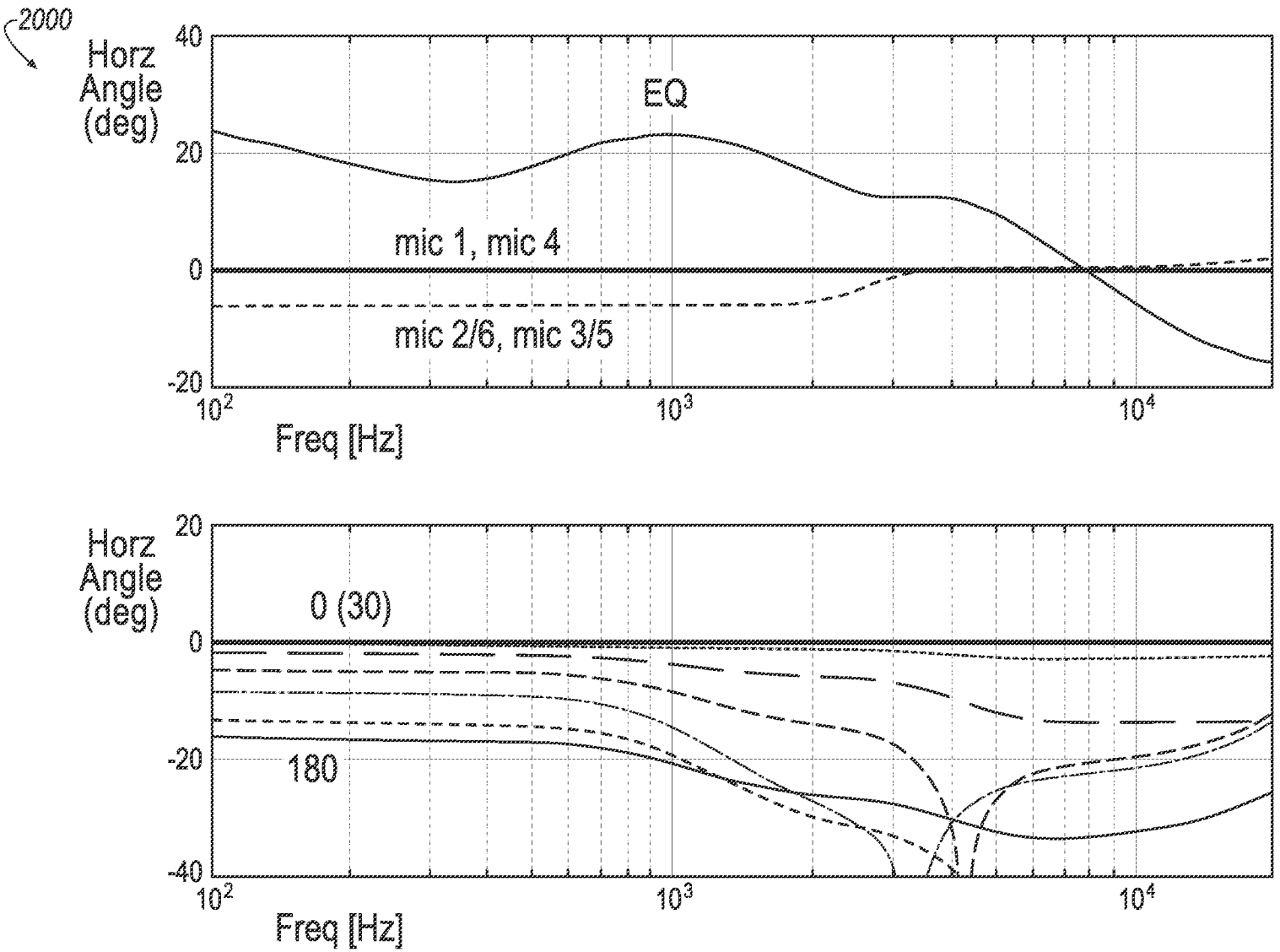
FIG. 20 illustrates an example of initial filters and angular attenuation for the microphone array.

FIG. 20 illustrates an example 2000 of initial filters and angular attenuation for the microphone array. As shown, the example 200 includes filter frequency responses $|H_m|$ for the front microphone 1, the rear microphone 4, and the side pairs 2/6 and 3/5, respectively, after normalization with respect to the front filter, which is shown as a EQ filter, to be applied to all microphones.

Figure 21:
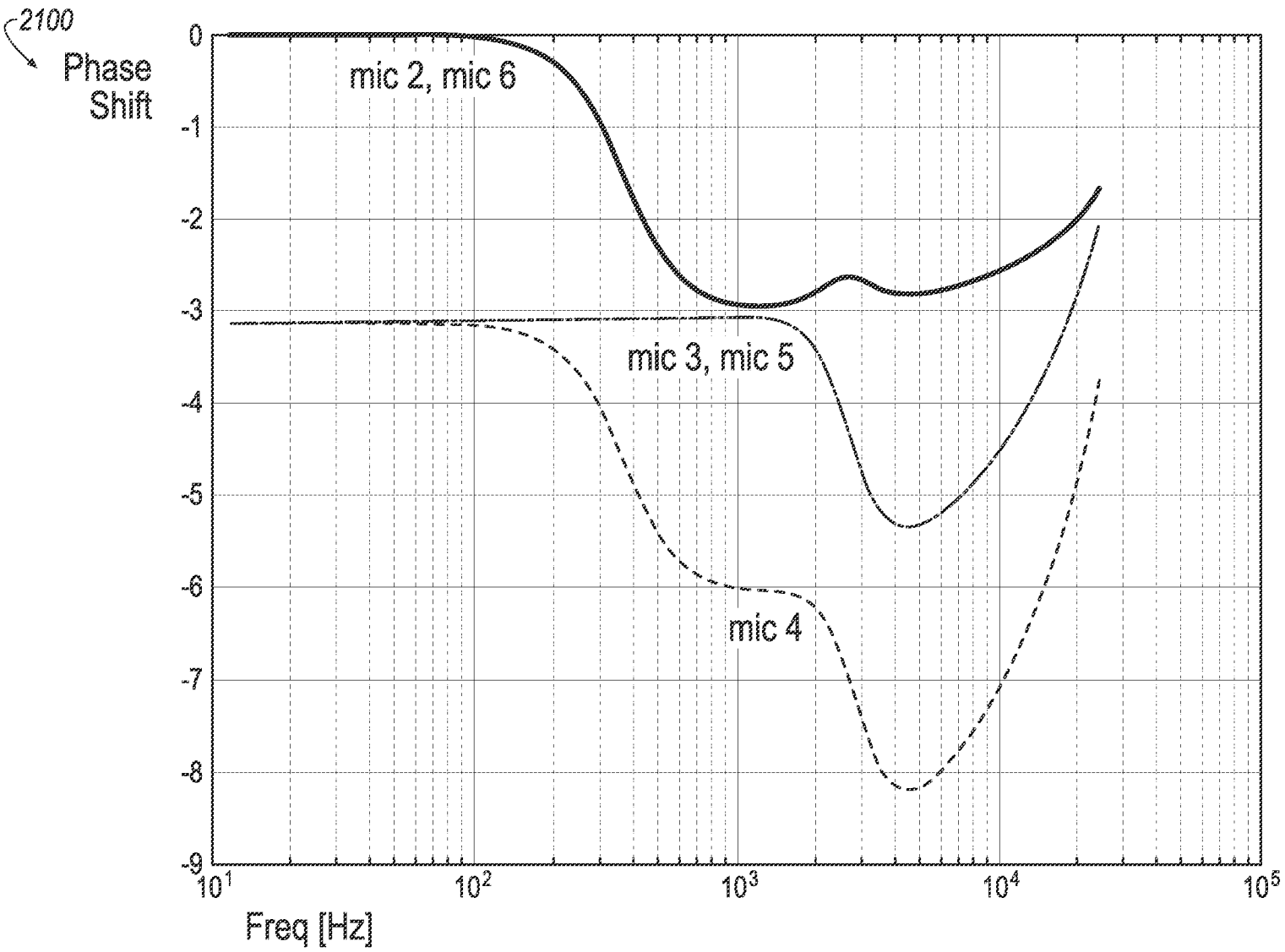
FIG. 21 illustrates phase responses of initial beam forming filters for the microphone array.

FIG. 21 illustrates an example 2100 of phase responses of initial beam forming filters for the microphone array. While the individual filter magnitudes are essentially flat, the EQ filter demands a gain of about 20 dB in a wide frequency interval, in order to make up for the losses due to opposite filter phases between microphones. This gain is undesirable because microphone self-noise is amplified by that amount. Referring to the nonlinear optimization, a primary design goal is to reduce that noise gain.

Figure 22:
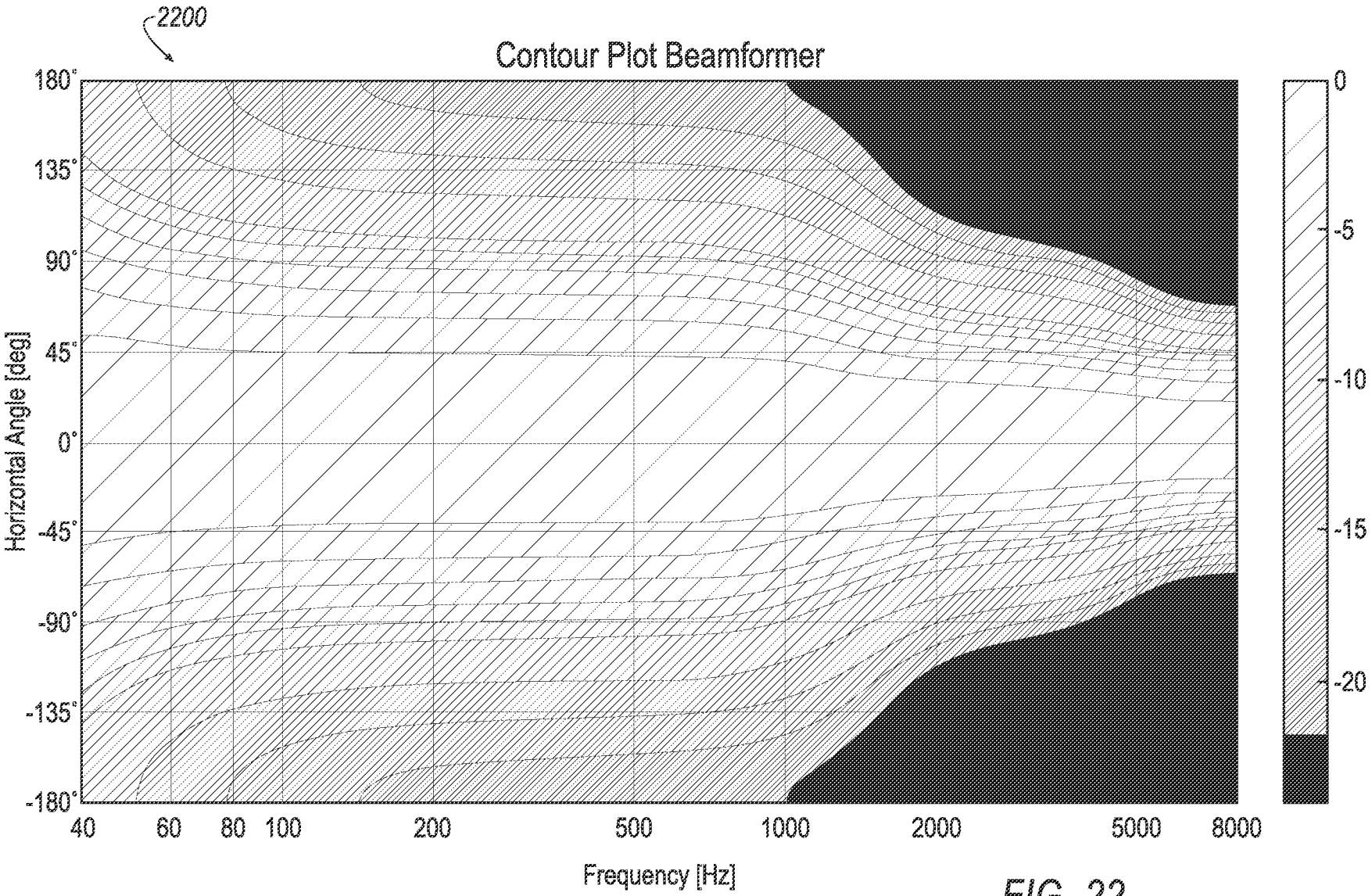
FIG. 22 illustrates an example contour plot of the microphone array beamformer.
Figure 23:
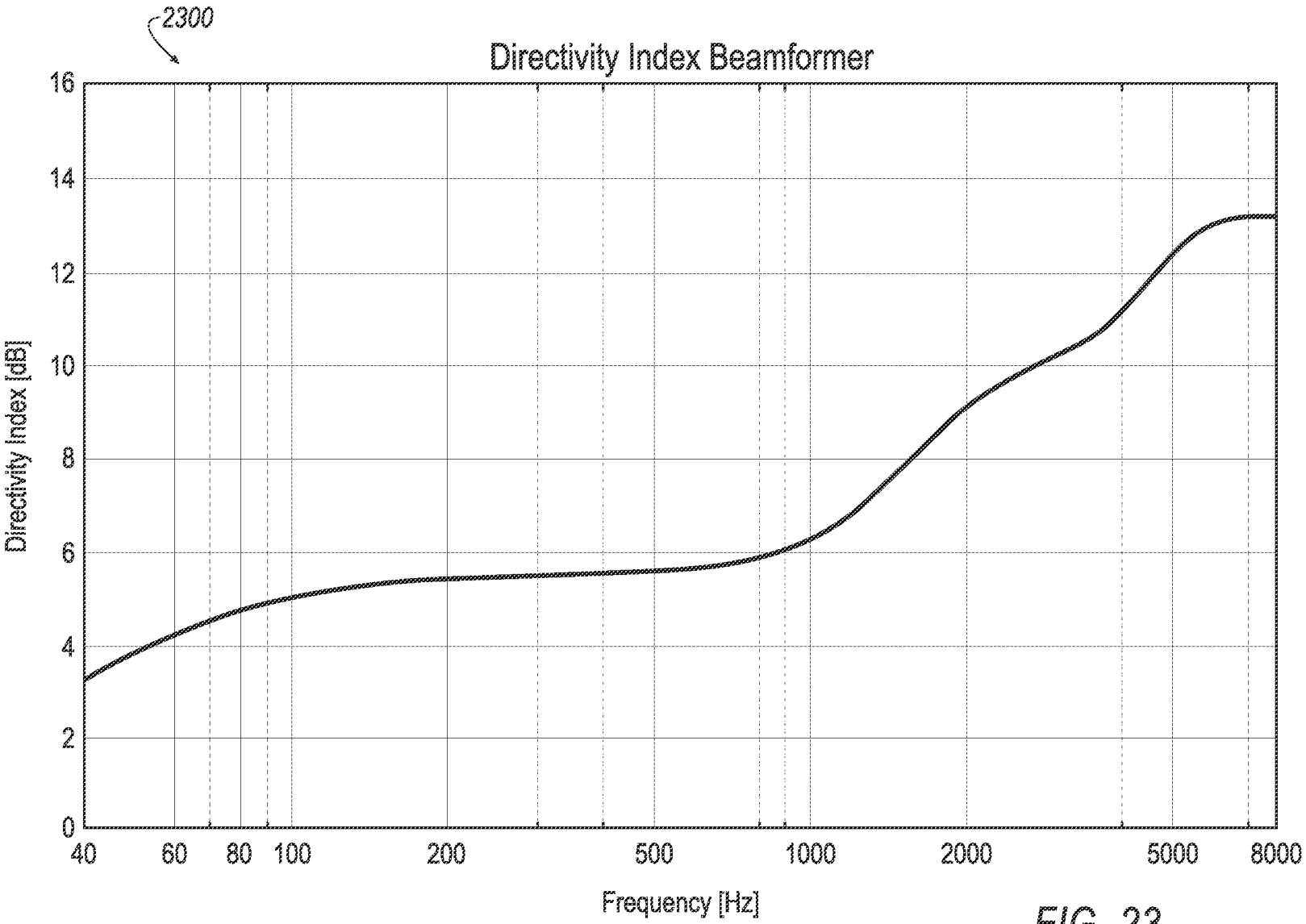
FIG. 23 illustrates an example directivity index of the microphone array beamformer.

FIG. 22 illustrates an example 2200 of a contour plot of the microphone array beamformer. FIG. 23 illustrates an example 2300 of a directivity index of the microphone array beamformer. The contour plot shown in FIG. 22 and the directivity index shown in FIG. 23 document the quality of the beam former.

Figure 24:
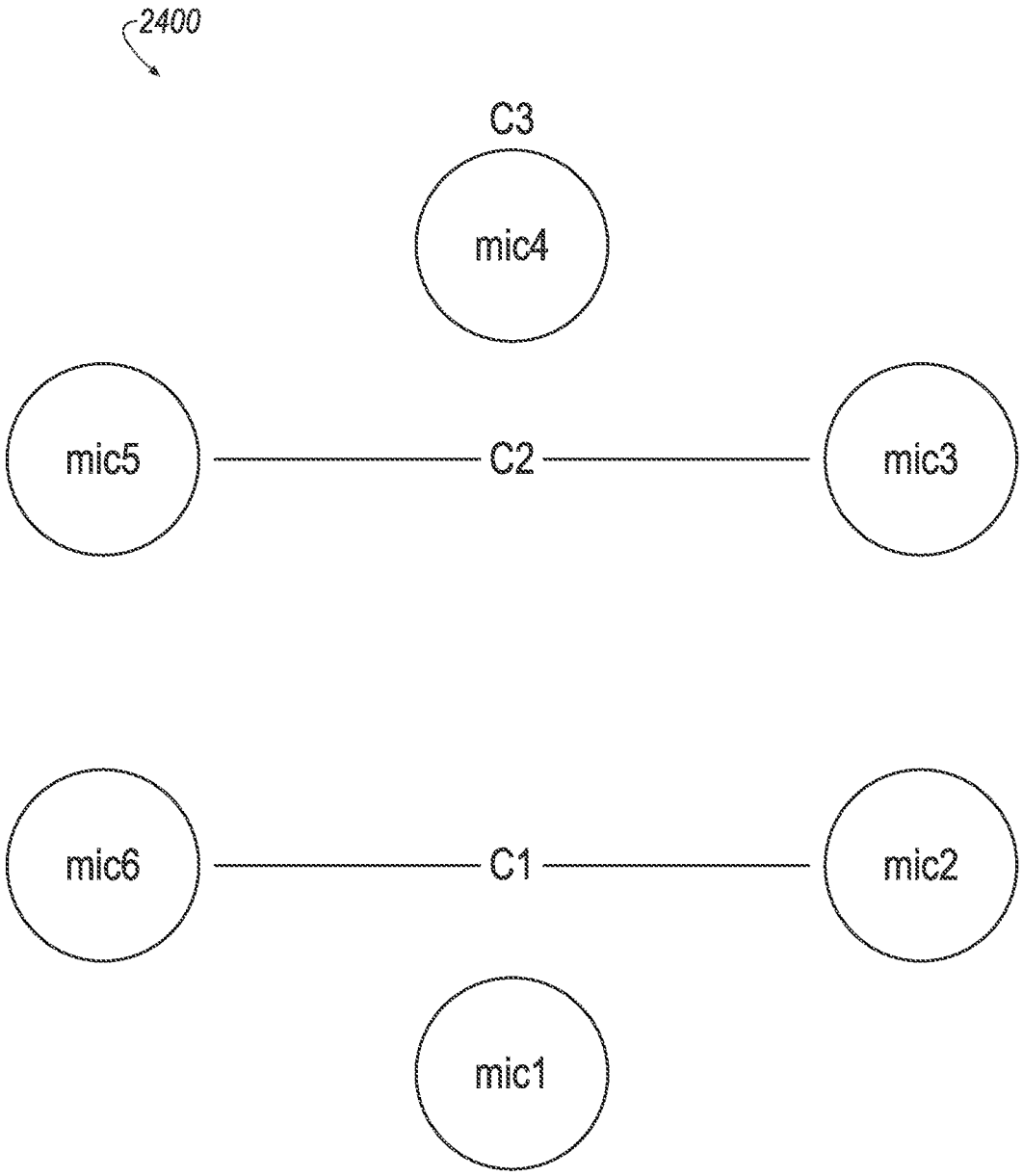
FIG. 24 illustrates an example microphone array layout having six microphones and three beamforming filters.

Regarding non-linear post optimization, FIG. 24 shows a six-microphone layout, with beam forming filters $C_1$, $C_2$ and $C_3$ to be determined. The method is similar to the previously described loudspeaker beam forming design.

First, the data is preconditioned by complex smoothing in the frequency domain, and normalization to the frontal transducer. Hence, the frequency response of the first transducer mic1 is set to constant one during the optimization. Instead of applying a beam forming filter to mic1, a global EQ filter applied to all microphones may be used.

Target function for the design are attenuation values $u_k$ at angles $\theta_k$=[0:15:180]°, which can be taken from the initial solution $u_k$ (f)=, |U(f, $\theta_k$)| see above. Since this response is frequency dependent, a number of constant target functions are used for different frequency intervals. For example, below a transition frequency $f_{tr}$=1000 Hz a first target function $u_k$ (f=2000 Hz) can be used for the approximation in the interval 100 Hz . . . 1000 Hz, then a second target function $u_k$ (f=4000 Hz) is used for the remaining interval 1000 Hz . . . 20 KHz. This method results in a subsequently narrower beam at higher frequencies.

The initial solution for $C_1$ . . . $C_3$ may be set to the previously-obtained beam forming filters $H_m$, as shown in FIGS. 20 and 21.

In addition to the allowed amplitude difference δ from one frequency iteration point i to the next point i+1:

$$|C_r(i)|\cdot(1-\delta) < |C_r(i+1)| < |C_r(i)|\cdot(1+\delta), \tag{17}$$

a phase boundary δp is applied:

$$\arg(C_r(i))\cdot(1-\delta_P)<\arg(C_r(i+1))<\arg(C_r(i))\cdot(1+\delta_P). \quad (18)$$

In summary, the following bounds are applied:

| | |
|---|---|
| Amplitude bound | $\delta = 0.75$ |
| Phase bound | $\delta = \pi/60$ |
| Max. beam filter gain | 12 dB |
| Max. EQ filter gain | 20 dB |

Figure 25:
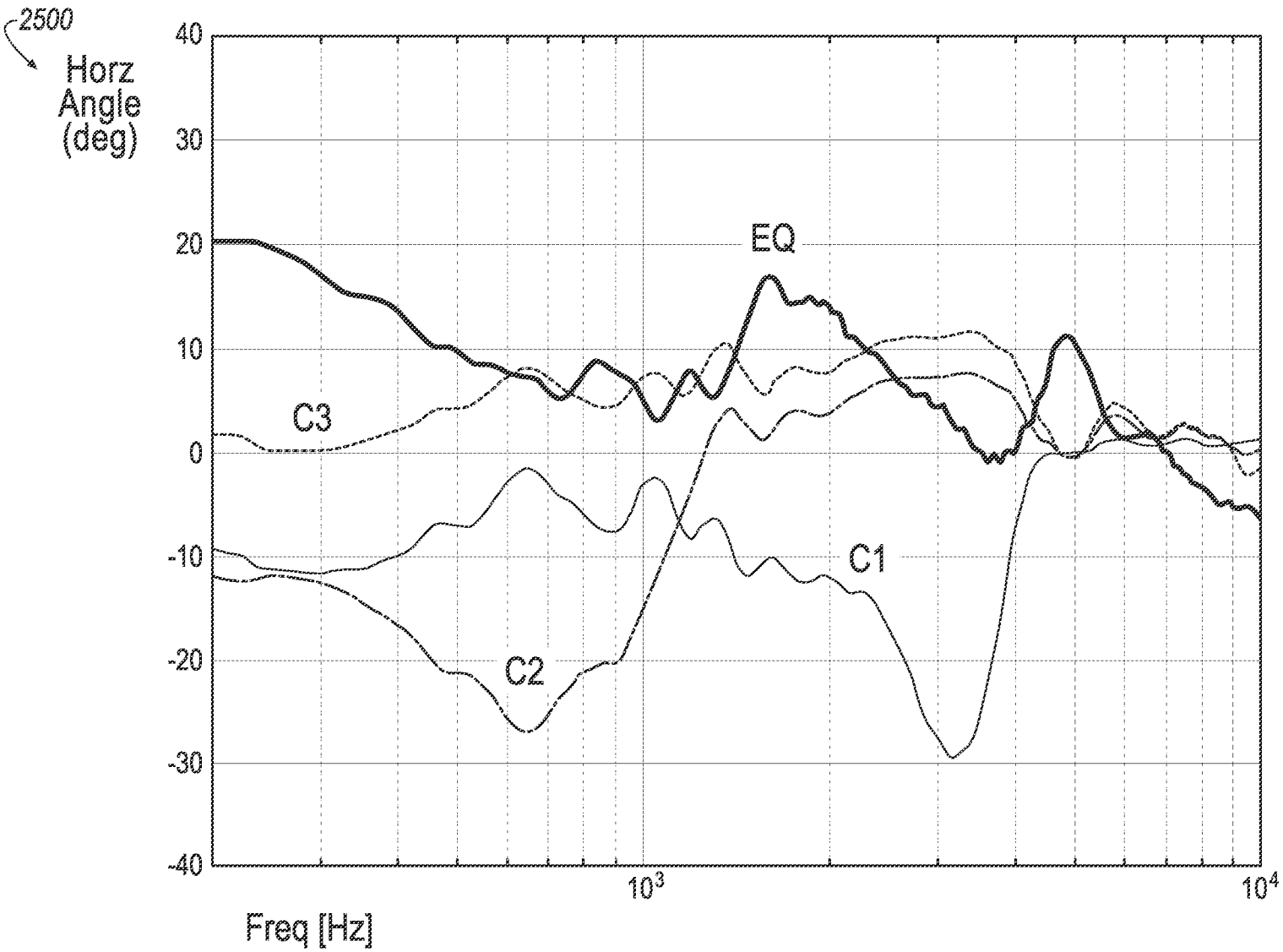
FIG. 25 illustrates an example frequency response of the microphone array beamforming and EQ filters after optimization.
Figure 26:
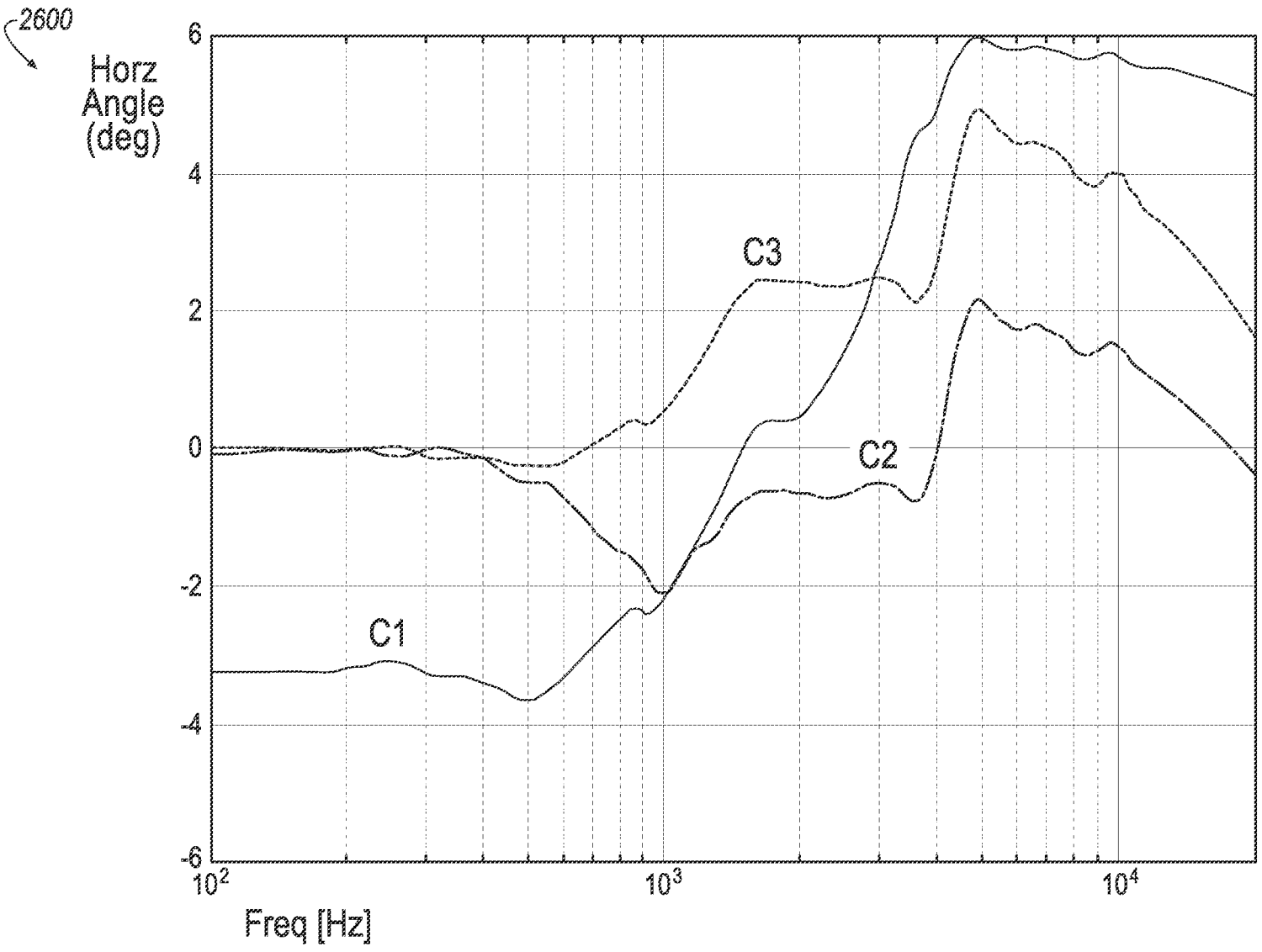
FIG. 26 illustrates example phase responses of the microphone array for optimal beam forming filters.

FIG. 25 illustrates an example 2500 of frequency response of the microphone array 112 after optimization. FIG. 26 illustrates an example 2600 of phase responses of the microphone array 112 for optimal beam forming filters. Accordingly, FIG. 25 and FIG. 26 show resulting magnitude and phase responses of the beam forming filters after non-linear post optimization.

The overall white noise gain may be calculated as:

$$\mathrm{WNG}=20\log\{|\mathrm{EQFilt}|\cdot\sqrt{1+2\cdot|C_1|^2+2\cdot|C_2|^2+|C_3|^2}\}. \quad (19)$$

Figure 27:
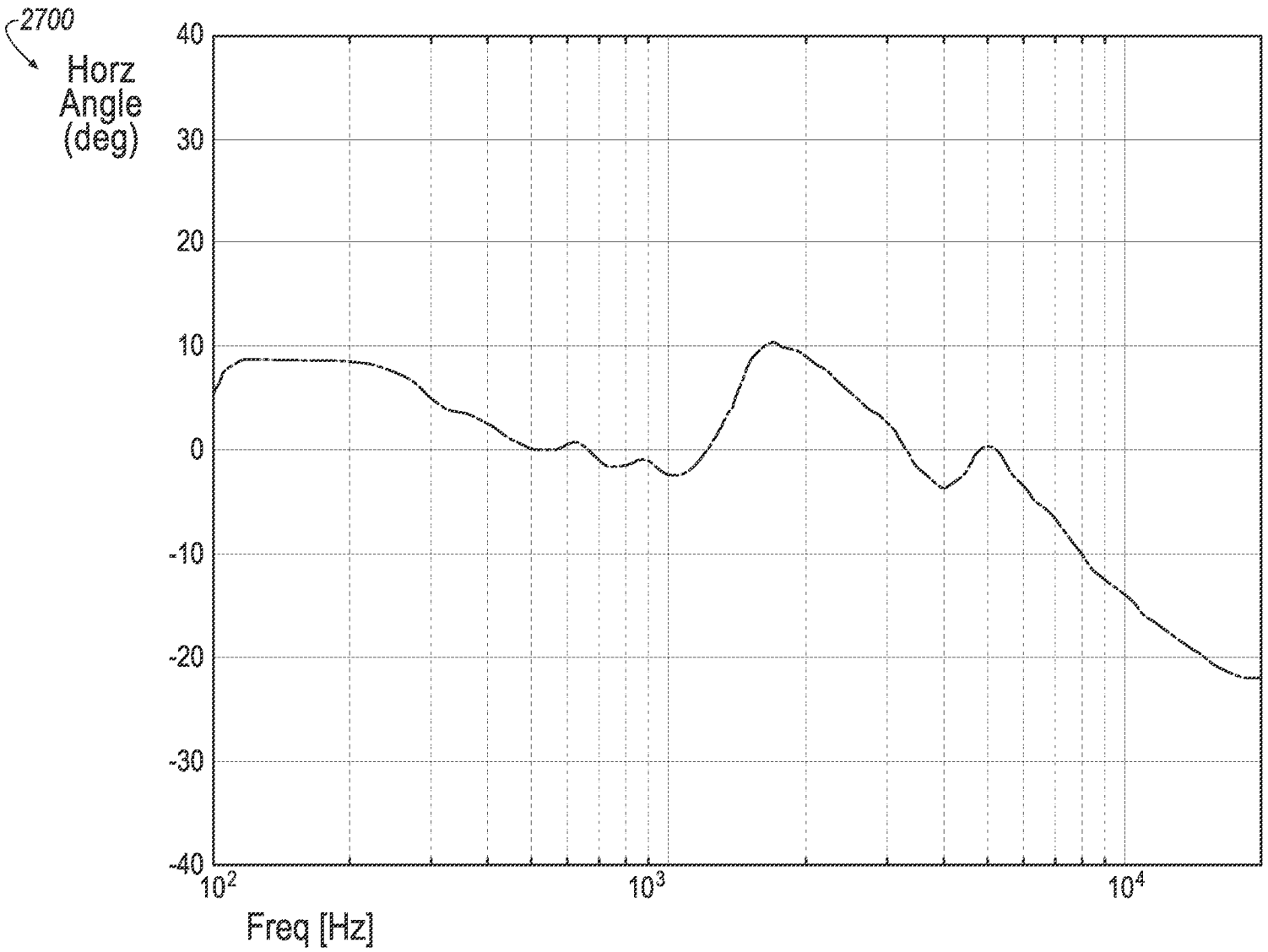
FIG. 27 illustrates an example of white noise gain.

FIG. 27 illustrates an example 2700 of white noise gain. The result, as depicted in FIG. 27, shows that the goal, to reduce white noise gain (WNG) from the initial 20 dB (see FIG. 20) to less than 10 dB has been reached, while performance has been improved.

Figure 28:
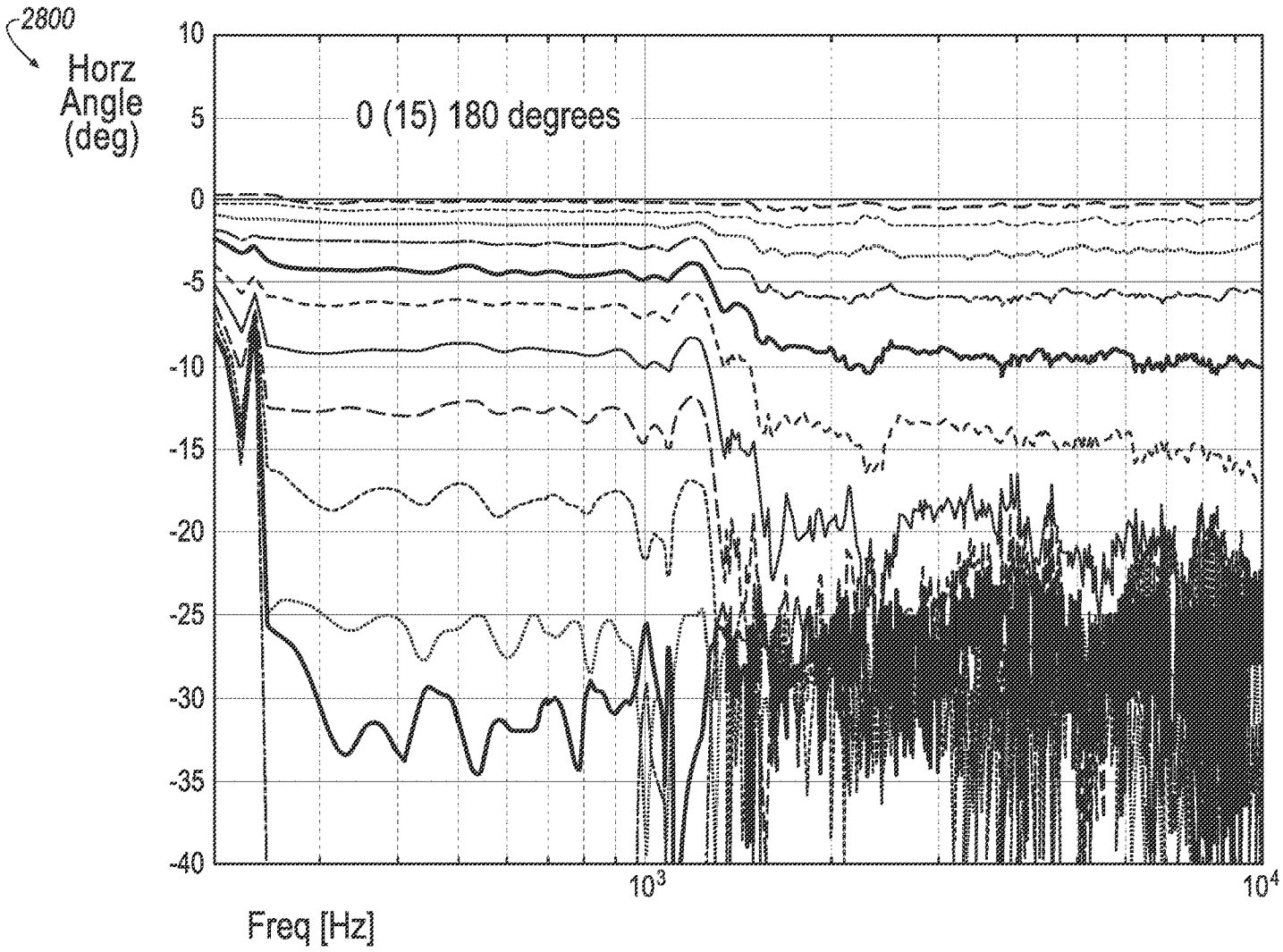
FIG. 28 illustrates an example of off-axis responses after optimization.
Figure 29:
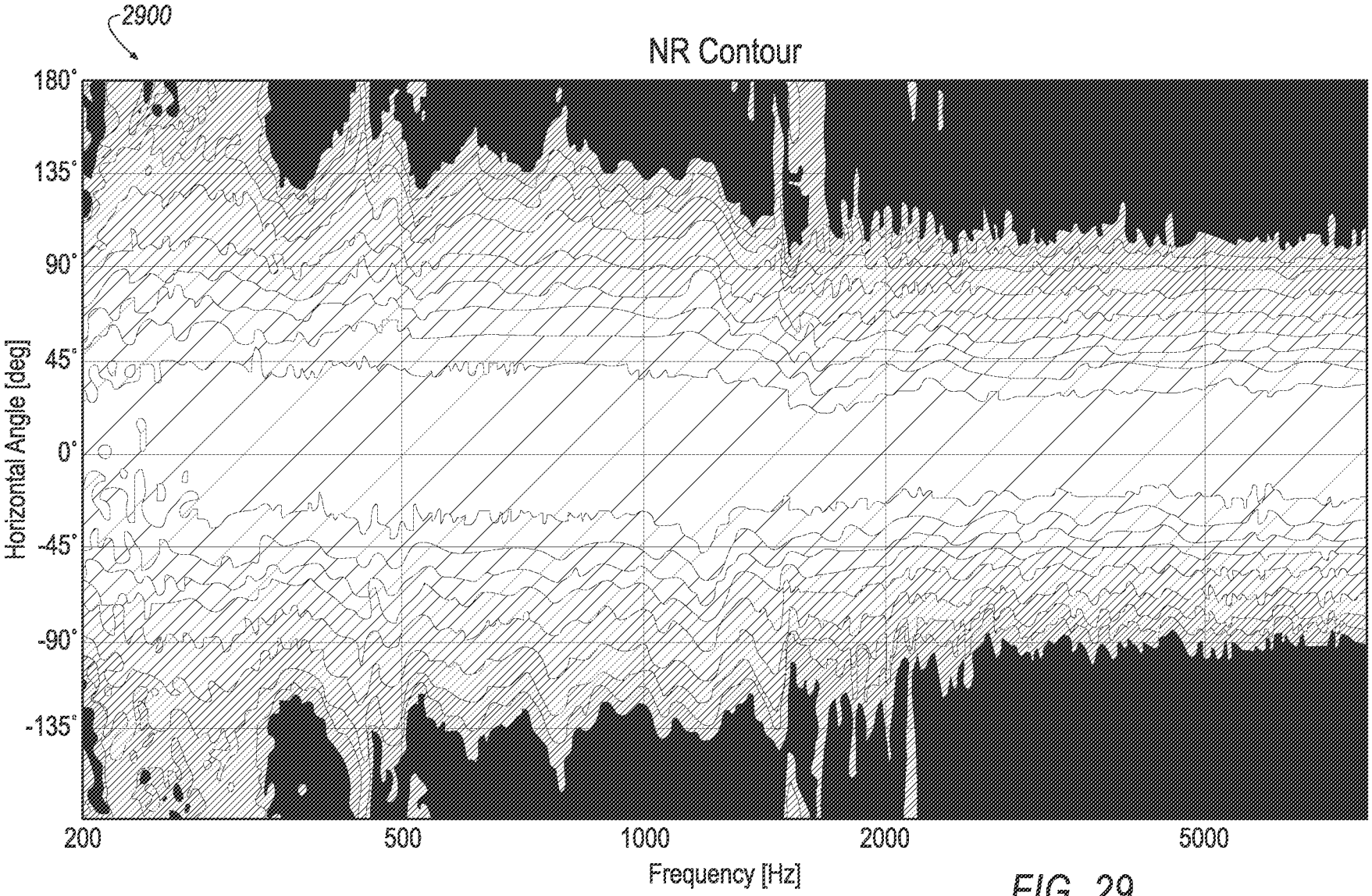
FIG. 29 illustrates an example contour plot of beam forming results after optimization.
Figure 30:
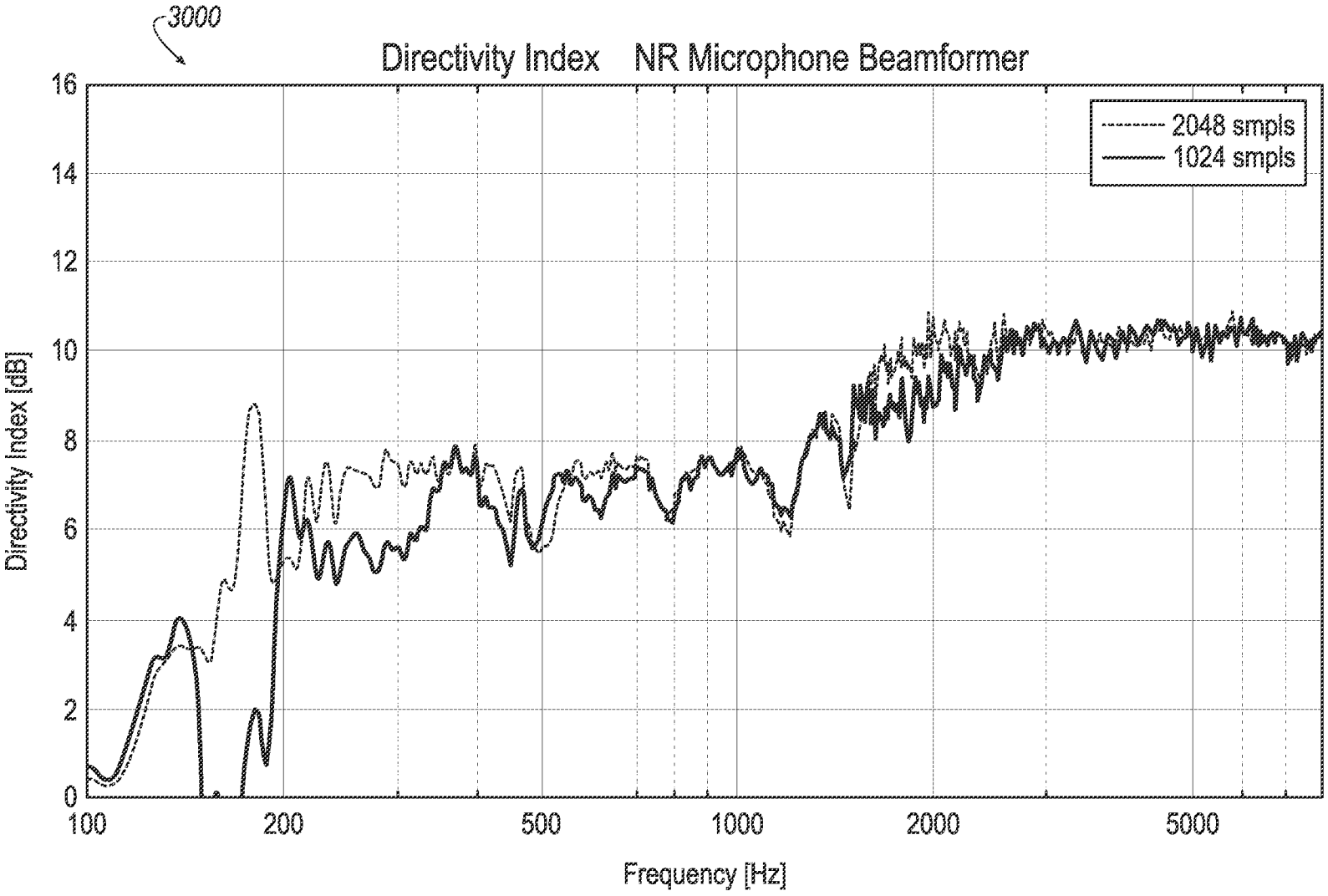
FIG. 30 illustrates an example directivity index of beam forming results after optimization at two different filter lengths.

FIG. 28 illustrates an example 2800 of off-axis responses after optimization. FIG. 29 illustrates an example 2900 of a contour plot of beam forming results after optimization. FIG. 30 illustrates an example 3000 of a directivity index of beam forming results after optimization at two different filter lengths. As can be seen by comparing FIGS. 28-30 with FIGS. 22-23, performance has been improved.

Figure 31:
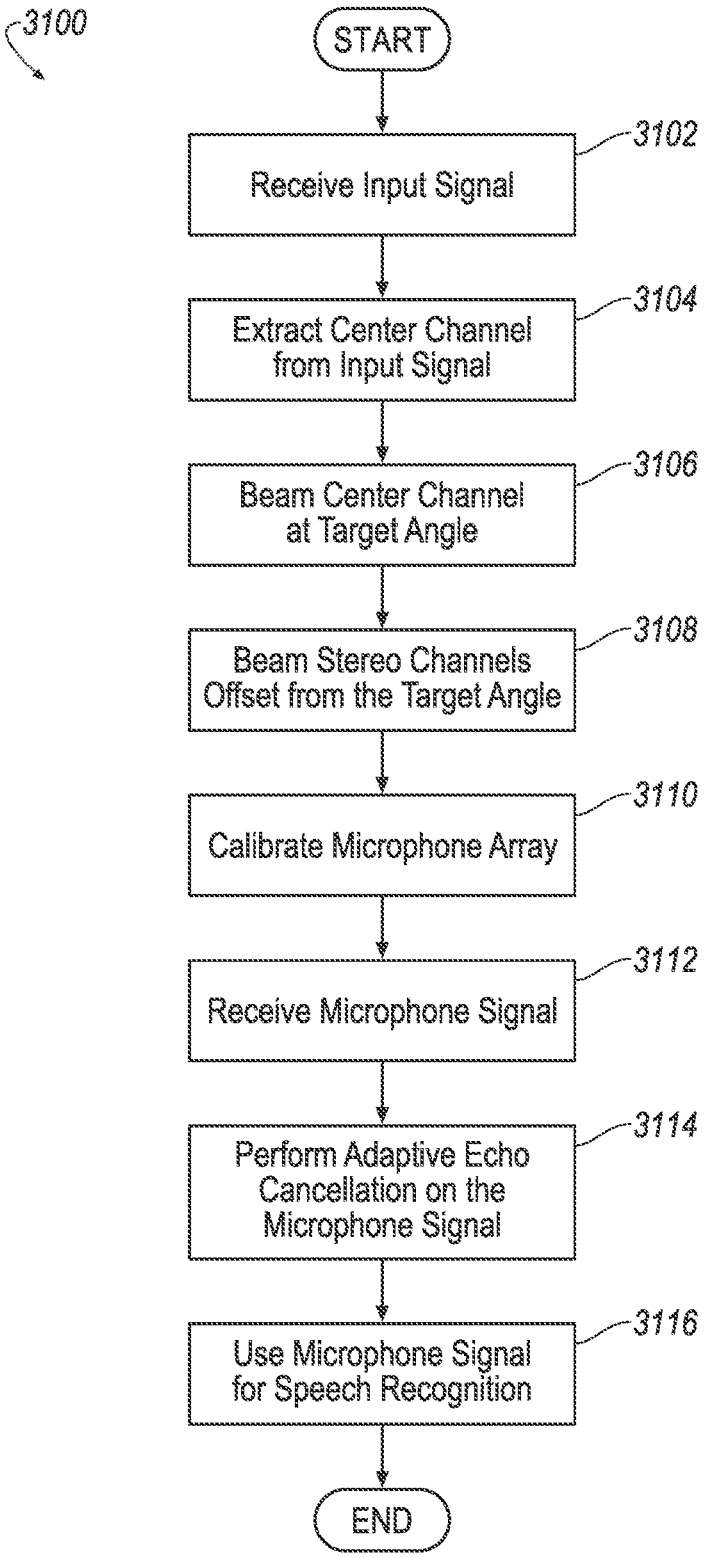
FIG. 31 illustrates an example process for operation of the loudspeaker.

FIG. 31 illustrates an example process 3100 for operation of the loudspeaker 100. In an example, the process may be performed by the loudspeaker 100 using the concepts discussed in detail above. At 3102, the variable acoustics loudspeaker 100 receives an input signal 102. In an example, the input may be a stereo signal provided to the variable acoustics loudspeaker 100 to be processed by the digital signal processor.

At operation 3104, the loudspeaker 100 extracts a center channel from the input signal. In an example, the upmixer 104 is configured to generate a center channel (C) out of the two-channel stereo sources (i.e., (L) and (R) of the audio input 102), resulting in upmixed signals 106 left minus center (L−C), center (C), and right minus center (R−C). Further aspects of the operation of the upmixer 104 are described in detail with respect to FIG. 6.

At operation 3106, the loudspeaker 100 generates a center channel beam for output by the loudspeaker 100. In an example, as discussed at least with respect to FIG. 8, a set of finite input response filters may be used by the digital signal processor to generate a plurality of output channels to be used for beamforming of the extracted center channel. The loudspeaker 100 may further generate a first beam of audio content at a target angle using a first rotation matrix. In an example, as discussed at least with respect to FIGS. 2 and 9, outputs of the filters may be routed to the speaker channels at the target angle. The loudspeaker 100 may apply the beam of audio content to the array of speaker elements, e.g., as shown in FIG. 9. In an example, the array of speaker elements are the six drivers of the tweeter array as shown in FIG. 7.

At operation 3108, the loudspeaker 100 generates stereo channel beams for output by the loudspeaker 100. In an example, as discussed at least with respect to FIG. 8, a set of finite input response filters may be used by the digital signal processor to generate a plurality of output channels to be used for beamforming of the (L) channel, and a second set of finite input response filters may be used by the digital signal processor to generate a second plurality of output channels to be used for beamforming of the (R) channel. The loudspeaker 100 may further generate a left beam of audio content at an angle offset from the target angle using a rotation matrix, and generate a right beam of audio content at an angle offset from the target angle in the opposite direction using another rotation matrix. In an example, as discussed at least with respect to FIGS. 2 and 9, outputs of the filters may be routed to the speaker channels at the target angle. The loudspeaker 100 may also apply these beams of audio content to the array of speaker elements, e.g., as shown in FIG. 9. In an example, the array of speaker elements are the six drivers of the tweeter array as shown in FIG. 7.

At 3110, the loudspeaker 100 calibrates the microphone array 112. In an example, the loudspeaker 100 calibrates the array of microphones 112 by convolution of the electrical signals from each of the microphones using a minimum phase correction filter and a target microphone that is one of the microphone elements of the array 112. In another example, the loudspeaker 100 performs an in-situ calibration including to estimate a frequency response of a reference microphone of the microphone array 112 using the audio playback of the array of speakers 110 as a reference signal, and equalizing the microphones of the array 112 according to the measured frequency response.

At operation 3112, the loudspeaker 100 receives microphone signals 114 from the microphone array 112. In an example, the processor of the loudspeaker 100 may be configured to receive the raw microphone signals 114 from the microphone array 112.

At operation 3114, the loudspeaker 100 performs echo cancellation on the received microphone signals 114. In an example, the loudspeaker 100 utilize a single adaptive acoustic echo canceller (AEC) 126 filter pair keyed to the stereo input for the array of microphone elements. It may be possible to use the single AEC as opposed to M AEC due to the short distance between the microphone elements of the array 112, as well as due to the calibration of the microphone array 112. Further aspects of the operation of the AEC are described above with respect to FIG. 1. By subtracting the AEC signal 128 from the microphone signals 114, audio content played back by the loudspeaker 100 (such as the L, R, and C beams) will be suppressed, and only the intended speech signal will be heard.

At operation 3116, the loudspeaker 100 performs speech recognition on the microphone signals 114 that are echo cancelled. Accordingly, the loudspeaker 100 may be able to respond to voice commands. After operation 3116, the process 3100 ends.

Figure 32:
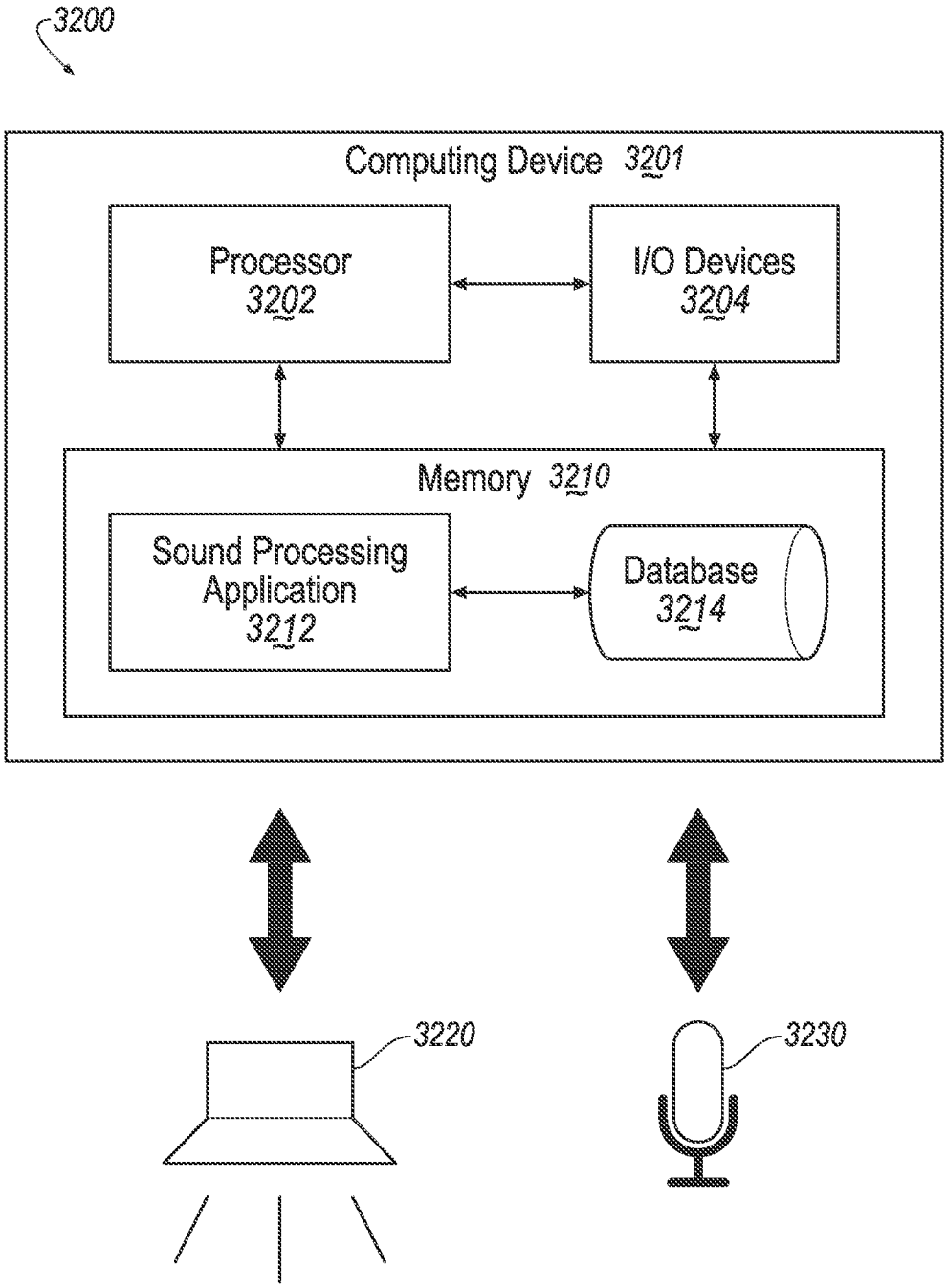
FIG. 32 is a conceptual block diagram of a computing system configured to implement one or more aspects of the various embodiments.

FIG. 32 is a conceptual block diagram of an audio system 3200 configured to implement one or more aspects of the various embodiments. These embodiments may include the process 3100, as one example. As shown, the audio system 3200 includes a computing device 3201, one or more speakers 3220, and one or more microphones 3230. The computing device 3201 includes a processor 3202, input/output (I/O) devices 3204, and a memory 3210. The memory 3210 includes an audio processing application 3212 configured to interact with a database 3214.

The processor 3202 may be any technically feasible form of processing device configured to process data and/or execute program code. The processor 3202 could include, for example, and without limitation, a system-on-chip (SoC), a central processing unit (CPU), a graphics processing unit (GPU), an application-specific integrated circuit (ASIC), a digital signal processor (DSP), a field-programmable gate array (FPGA), and so forth. Processor 3202 includes one or more processing cores. In operation, processor 3202 is the master processor of computing device 3201, controlling and coordinating operations of other system components.

I/O devices 3204 may include input devices, output devices, and devices capable of both receiving input and providing output. For example, and without limitation, I/O devices 3204 could include wired and/or wireless communication devices that send data to and/or receive data from the speaker(s) 3220, the microphone(s) 3230, remote databases, other audio devices, other computing devices, etc.

Memory 3210 may include a memory module or a collection of memory modules. The audio processing application 3212 within memory 3210 is executed by the processor 3202 to implement the overall functionality of the computing device 3201 and, thus, to coordinate the operation of the audio system 3200 as a whole. For example, and without limitation, data acquired via one or more microphones 3230 may be processed by the audio processing application 3212 to generate sound parameters and/or audio signals that are transmitted to one or more speakers 3220. The processing performed by the audio processing application 3212 may include, for example, and without limitation, filtering, statistical analysis, heuristic processing, acoustic processing, and/or other types of data processing and analysis.

The speaker(s) 3220 are configured to generate sound based on one or more audio signals received from the computing system 3200 and/or an audio device (e.g., a power amplifier) associated with the computing system 3200. The microphone(s) 3230 are configured to acquire acoustic data from the surrounding environment and transmit signals associated with the acoustic data to the computing device 3201. The acoustic data acquired by the microphone(s) 3230 could then be processed by the computing device 3201 to determine and/or filter the audio signals being reproduced by the speaker(s) 3220. In various embodiments, the microphone(s) 3230 may include any type of transducer capable of acquiring acoustic data including, for example and without limitation, a differential microphone, a piezoelectric microphone, an optical microphone, etc.

Generally, computing device 3201 is configured to coordinate the overall operation of the audio system 3200. In other embodiments, the computing device 3201 may be coupled to, but separate from, other components of the audio system 3200. In such embodiments, the audio system 3200 may include a separate processor that receives data acquired from the surrounding environment and transmits data to the computing device 3201, which may be included in a separate device, such as a personal computer, an audio-video receiver, a power amplifier, a smartphone, a portable media player, a wearable device, etc. However, the embodiments disclosed herein contemplate any technically feasible system configured to implement the functionality of the audio system 3200.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A smart loudspeaker comprising:

an array of N speaker elements disposed in a circular configuration about an axis and configured for multi-channel audio playback;

an array of M microphone elements disposed in a circular configuration about the axis and configured to receive audio signals and provide input electrical signals; and a digital signal processor, programmed to:

extract a center channel from a stereo input, apply the center channel to the array of speaker elements using a first set of finite impulse response filters and a first rotation matrix to generate a first beam of audio content at a target angle about the axis, apply a left channel of the stereo input to the array of speaker elements using a second set of finite impulse response filters and a second rotation matrix to generate a second beam of audio content at a first offset angle from the target angle about the axis, apply a right channel of the stereo input to the array of speaker elements using a third set of finite impulse response filters and a third rotation matrix to generate a third beam of audio content at a second offset angle from the target angle about the axis, utilize a microphone beamformer to perform steerable microphone array beam forming of the input electrical signals at the target angle to receive speech input, and utilize a single adaptive acoustic echo canceller (AEC) filter pair keyed to the stereo input for the array of microphone elements, the AEC filter using, as a reference signal, an average of the input electrical signals received from the array of microphone elements.

2. The smart loudspeaker of claim 1, wherein to extract the center channel using the digital signal processor comprises a high-frequency path that performs center extraction on high frequencies at a first sampling rate, a low-frequency path that performs center extraction on low frequencies at a second sampling rate lower than the first sampling rate, and an adder that combines an output of the high-frequency path and an output of the low-frequency path to create the center channel.

3. The smart loudspeaker of claim 1, wherein the digital signal processor is further programmed to calibrate the array of M microphone elements by convolution of the electrical signals from each of the microphones using a minimum phase correction filter and a target microphone that is one of the microphone elements of the array.

4. The smart loudspeaker of claim 3, wherein the array of microphone elements further includes a microphone element at a center of the circular configuration, wherein the target microphone is the center microphone.

5. The smart loudspeaker of claim 1, wherein the digital signal processor is further programmed to calibrate the array of microphones using an in-situ calibration comprising to:

estimate a frequency response of a reference microphone of the microphone array using the audio playback of the array of speaker elements as a reference signal; and equalize the microphones of the array according to the frequency response.

6. The smart loudspeaker of claim 1, wherein a diameter of the array of microphones is ten millimeters.

7. The smart loudspeaker of claim 3, wherein M is 6-8.

8. A method for a smart loudspeaker comprising:

extracting a center channel from a stereo input;

applying the center channel, to an array of speaker elements disposed in a circular configuration about an axis and configured for multi-channel audio playback, using a first set of finite impulse response filters and a first rotation matrix to generate a first beam of audio content at a target angle about the axis;

applying a left channel of the stereo input to the array of speaker elements using a second set of finite impulse response filters and a second rotation matrix to generate a second beam of audio content at a first offset angle from the target angle about the axis;

applying a right channel of the stereo input to the array of speaker elements using a third set of finite impulse response filters and a third rotation matrix to generate a third beam of audio content at a second offset angle from the target angle about the axis;

utilizing a microphone beamformer to perform steerable microphone array beam forming at the target angle to receive speech input from an array of M microphone elements disposed in a circular configuration about the axis and configured to receive audio signals and provide electrical signals; and utilize a single adaptive acoustic echo canceller (AEC) filter pair keyed to the stereo input for the array of microphone elements, the AEC filter using, as a reference signal, an average of the input electrical signals received from the array of microphone elements.

9. The method of claim 8, further comprising utilizing a high-frequency path that performs center extraction on high frequencies at a first sampling rate, a low-frequency path that performs center extraction on low frequencies at a second sampling rate lower than the first sampling rate, and an adder that combines an output of the high-frequency path and an output of the low-frequency path to create the center channel.

10. The method of claim 8, further comprising calibrating the array of microphone elements by convolution of the electrical signals from each of the microphones using a minimum phase correction filter and a target microphone that is one of the microphone elements of the array.

11. The method of claim 10, wherein the array of M microphone elements further includes a microphone element at a center of the circular configuration, wherein the target microphone is the center microphone.

12. The method of claim 8, further comprising calibrating the array of microphones using an in-situ calibration including:

estimating a frequency response of a reference microphone of the microphone array using the audio playback of the array of speaker elements as a reference signal; and equalizing the microphones of the array according to the measured frequency response.

13. The method of claim 8, wherein a diameter of the array of microphones is ten millimeters.

14. A non-transitory computer readable medium comprising instructions that, when executed by a processor of a smart loudspeaker, cause the processor to:

extract a center channel from a stereo input;

apply the center channel, to an array of speaker elements disposed in a circular configuration about an axis and configured for multi-channel audio playback, using a first set of finite impulse response filters and a first rotation matrix to generate a first beam of audio content at a target angle about the axis;

apply a left channel of the stereo input to the array of speaker elements using a second set of finite impulse response filters and a second rotation matrix to generate a second beam of audio content at a first offset angle from the target angle about the axis;

apply a right channel of the stereo input to the array of speaker elements using a third set of finite impulse response filters and a third rotation matrix to generate a third beam of audio content at a second offset angle from the target angle about the axis;

utilize a microphone beamformer to perform steerable microphone array beam forming at the target angle to receive speech input from an array of M microphone elements disposed in a circular configuration about the axis and configured to receive audio signals and provide electrical signals; and utilize a single adaptive acoustic echo canceller (AEC) filter pair keyed to the stereo input for the array of microphone elements, the AEC filter using, as a reference signal, an average of input electrical signals received from the array of microphone elements.

15. The medium of claim 14, further comprising instructions that, when executed by the processor of the smart loudspeaker, cause the processor to utilize a high-frequency path that performs center extraction on high frequencies at a first sampling rate, a low-frequency path that performs center extraction on low frequencies at a second sampling rate lower than the first sampling rate, and an adder that combines an output of the high-frequency path and an output of the low-frequency path to create the center channel.

16. The medium of claim 14, further comprising instructions that, when executed by the processor of the smart loudspeaker, cause the processor to calibrate the array of microphone elements by convolution of the electrical signals from each of the microphones using a minimum phase correction filter and a target microphone that is one of the microphone elements of the array.

17. The medium of claim 16, wherein the array of M microphone elements further includes a microphone element at a center of the circular configuration, wherein the target microphone is the center microphone.

18. The medium of claim 14, further comprising instructions that, when executed by the processor of the smart loudspeaker, cause the processor to calibrate the array of microphones using an in-situ calibration including:

estimating a frequency response of a reference microphone of the microphone array using the audio playback of the array of speaker elements as a reference signal; and equalizing the microphones of the array according to the measured frequency response.

19. The medium of claim 14, wherein a diameter of the array of microphones is ten millimeters.

* * * * *